US011669023B2

(12) United States Patent
Nakamura et al.

(10) Patent No.: US 11,669,023 B2
(45) Date of Patent: Jun. 6, 2023

(54) LIGHT EMITTING DEVICE, OPTICAL MEASUREMENT APPARATUS, AND IMAGE FORMING APPARATUS

(71) Applicant: FUJIFILM Business Innovation Corp., Tokyo (JP)

(72) Inventors: Kento Nakamura, Kanagawa (JP); Yosuke Kasuya, Kanagawa (JP); Nobutaka Hara, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/547,225

(22) Filed: Dec. 10, 2021

(65) Prior Publication Data

US 2023/0067040 A1 Mar. 2, 2023

(30) Foreign Application Priority Data

Aug. 25, 2021 (JP) ..... JP2021-137615

(51) Int. Cl.
*G03G 15/00* (2006.01)
*G03G 15/04* (2006.01)
*G03G 15/043* (2006.01)

(52) U.S. Cl.
CPC ..... *G03G 15/04036* (2013.01); *G03G 15/043* (2013.01); *G03G 15/5045* (2013.01)

(58) Field of Classification Search
CPC ..... G03G 15/04036; G03G 15/04054; G03G 15/043; G03G 15/5045
See application file for complete search history.

(56) References Cited

U.S. PATENT DOCUMENTS

| | | | | |
|---|---|---|---|---|
| 7,583,283 | B2 | 9/2009 | Matsushita et al. | |
| 7,679,635 | B2 | 3/2010 | Taira et al. | |
| 8,305,407 | B2 | 11/2012 | Taira | |
| 2004/0130609 | A1* | 7/2004 | Maeda | H04N 1/024 347/111 |
| 2008/0232856 | A1* | 9/2008 | Matsushita | G03G 15/04054 399/220 |
| 2017/0235258 | A1* | 8/2017 | Wada | G03G 15/5029 399/66 |
| 2020/0249320 | A1 | 8/2020 | Sakita et al. | |
| 2020/0274320 | A1 | 8/2020 | Inada et al. | |

FOREIGN PATENT DOCUMENTS

| | | |
|---|---|---|
| JP | H03268959 | 11/1991 |
| JP | H09251561 | 9/1997 |
| JP | 2002370400 | 12/2002 |
| JP | 2006082249 | 3/2006 |

(Continued)

OTHER PUBLICATIONS

"Search Report of Europe Counterpart Application", dated Oct. 10, 2022, p. 1-p. 8.

*Primary Examiner* — Hoang X Ngo
(74) *Attorney, Agent, or Firm* — JCIPRNET

(57) ABSTRACT

A light emitting device includes: a member having a first surface facing in one direction and a second surface facing an opposite side to the first surface; a light emitter that is disposed at the first surface, generates heat due to light emission, and has a lower stiffness than the member; and a heater that is disposed at the second surface of the member, and heats the member from the second surface.

20 Claims, 16 Drawing Sheets

(56) References Cited

FOREIGN PATENT DOCUMENTS

| | | |
|---|---|---|
| JP | 2008093855 | 4/2008 |
| JP | 2008132741 | 6/2008 |
| JP | 2008221721 | 9/2008 |
| JP | 2008229908 | 10/2008 |
| JP | 2010228213 | 10/2010 |
| JP | 2015099869 | 5/2015 |
| JP | 2020126980 | 8/2020 |
| JP | 2020141019 | 9/2020 |

* cited by examiner

LIGHT EMITTING DEVICE, OPTICAL MEASUREMENT APPARATUS, AND IMAGE FORMING APPARATUS

CROSS-REFERENCE TO RELATED APPLICATIONS

This application is based on and claims priority under 35 USC 119 from Japanese Patent Application No. 2021-137615 filed on Aug. 25, 2021.

BACKGROUND

(i) Technical Field

The present disclosure relates to a light emitting device, an optical measurement apparatus, and an image forming apparatus.

(ii) Related Art

Japanese Unexamined Patent Application Publication No. 2020-126980 describes a light emitting device including: a base material mounted on a wiring substrate; a light emitting device array provided on the base material; an opposed area which is opposed to the light emitting device array and connected to the light emitting device array, and provided on the surface of the base material along the lateral surface of the light emitting device array; a first conductive pattern having an extension area extended across the opposed area; and a plurality of penetrating members which are connected to the opposed area and the extension area, and penetrate the back side of the base material.

SUMMARY

Aspects of non-limiting embodiments of the present disclosure relate to reducing thermal deformation of a member due to heat generation of a light emitter.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a light emitting device including: a member having a first surface facing in one direction and a second surface facing an opposite side to the first surface; a light emitter that is disposed at the first surface, generates heat due to light emission, and has a lower stiffness than the member; and a heater that is disposed at the second surface of the member, and heats the member from the second surface.

BRIEF DESCRIPTION OF THE DRAWINGS

Exemplary embodiments of the present disclosure will be described in detail based on the following figures, wherein.

DETAILED DESCRIPTION

First Exemplary Embodiment

A light emitting device 10 according to a first exemplary embodiment of the present disclosure will be described with reference to FIG. 1 to FIG. 3.

Figure 1:
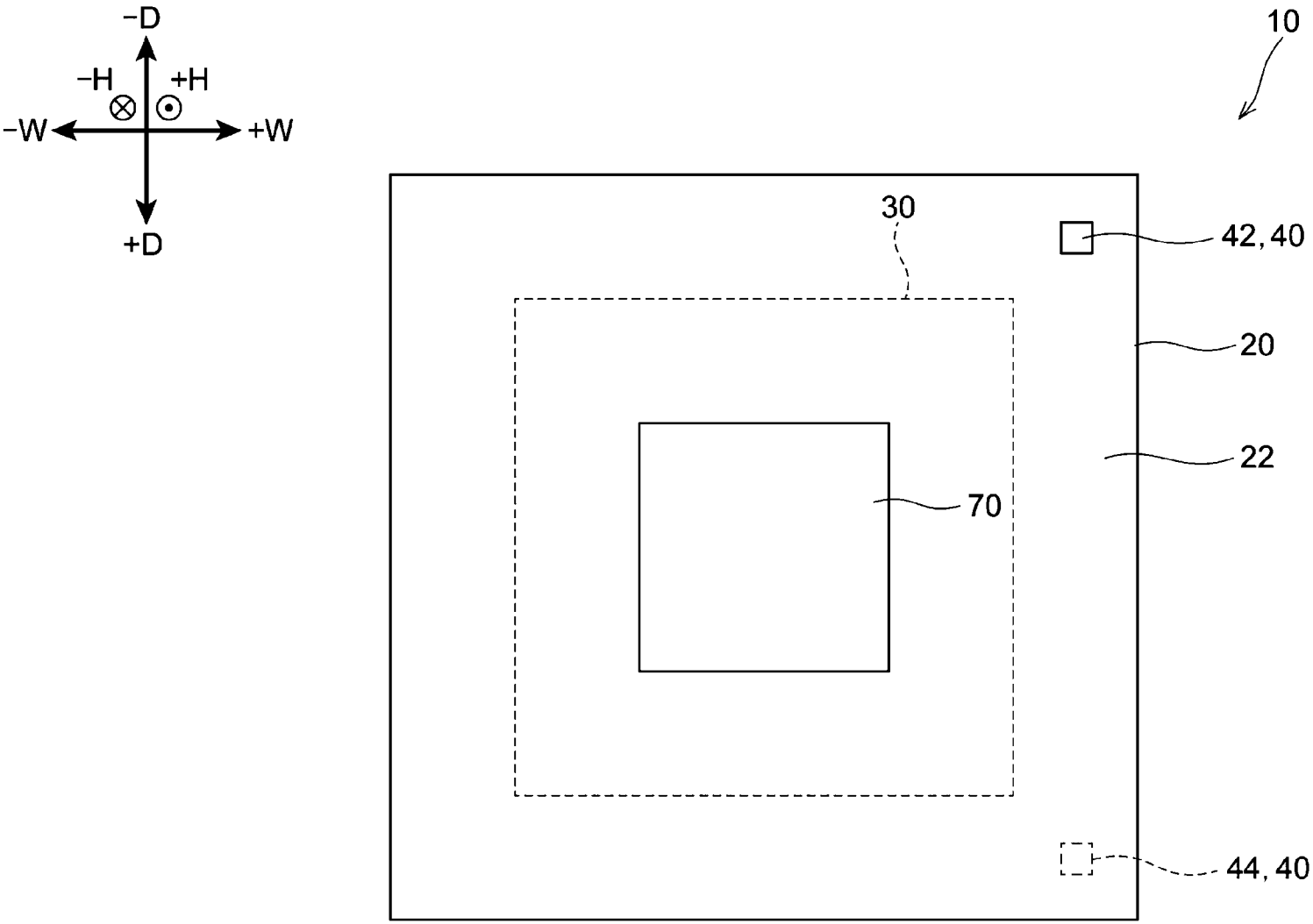
FIG. 1 is a plan view illustrating the configuration of a light emitting device according to a first exemplary embodiment.
Figure 2:
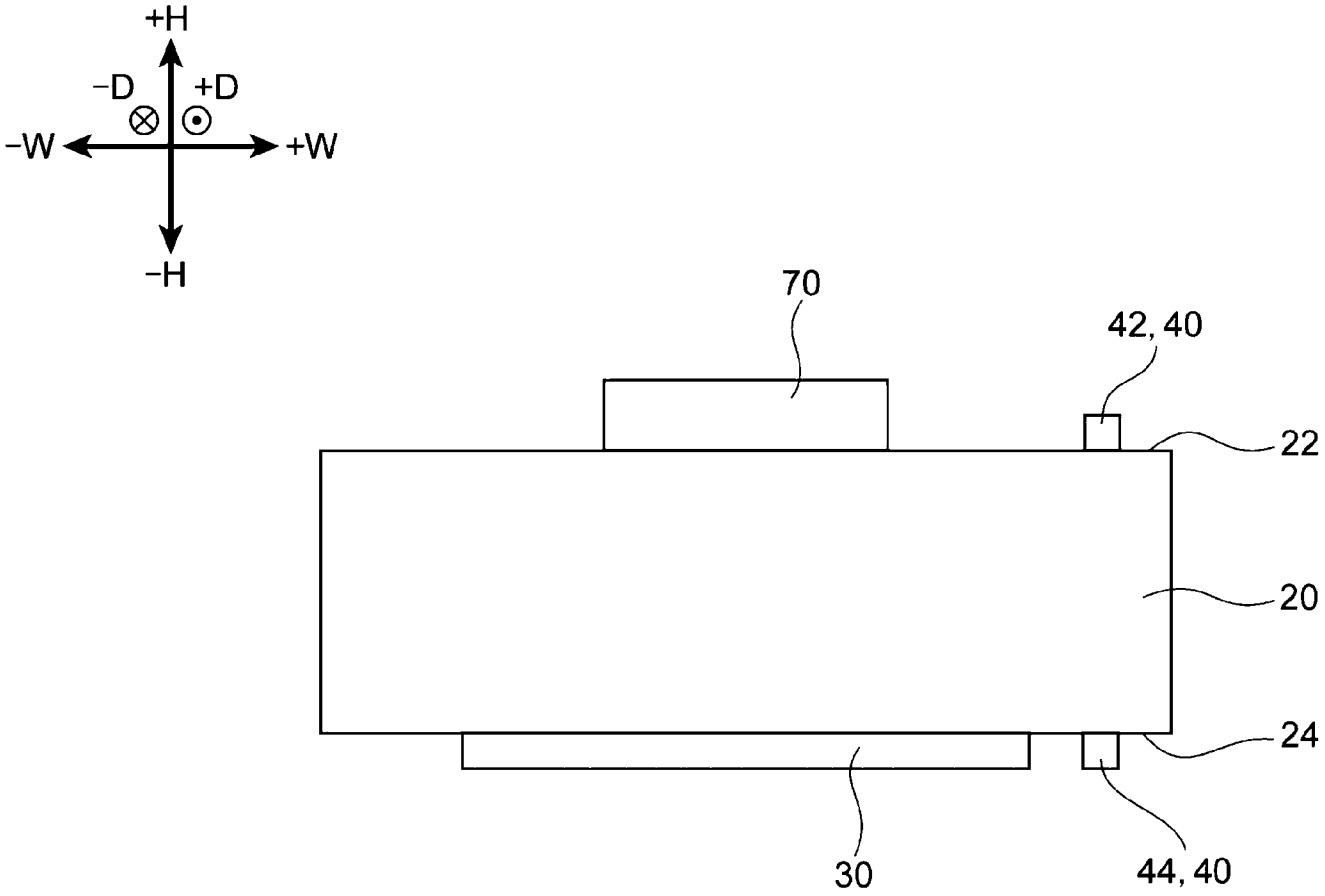
FIG. 2 is a front view illustrating the configuration of the light emitting device according to the first exemplary embodiment.

Note that in the description below, as illustrated in FIG. 1, the light emission direction of the light emitting device 10 is referred to as an upper direction in a device up-down direction, and two directions orthogonal to each other and perpendicular to the device up-down direction are referred to as a device depth direction and a device width direction. In the drawings, the device up-down direction (vertical direction), the device width direction (horizontal direction), and the device depth direction (horizontal direction) are denoted by H direction, W direction, and D direction, respectively. When it is necessary to distinguish between one side and the other side of each of the device up-down direction, the device width direction, and the device depth direction, in a plan view of the light emitting device 10 from the top, the upper side, the lower side, the right side, the left side, the depth side, and the near side are denoted by −D side, +D side, +W side, −W side, −H side, +H side, respectively.

The light emitting device 10 according to the first exemplary embodiment is a device that emits light to +H side. In other words, the light emitting device 10 is a device that radiates light to +H side. As illustrated in FIG. 1 and FIG. 2, the light emitting device 10 includes a base material 20, a light emitter 70, and a heater 30. In addition, the light emitting device 10 further includes a detector 40, and a controller 50 (illustration is omitted). The controller 50 controls the operation of each component. The details of the controller 50 will be described below.

The base material 20 is a rectangular plate which is along D-W plane and has an upper surface 22 facing +H side and a lower surface 24 facing −H side. The upper surface 22 is an example of a surface. The lower surface 24 is an example of another surface. The base material 20 is an example of a member. The base material 20 is, for example, a block made of metal, such as stainless steel, and has a higher stiffness than the later-described light emitter 70.

Note that the base material 20 in the present exemplary embodiment is not necessarily comprised of a metal block as long as the base material 20 has a higher stiffness than the light emitter 70. For example, the base material 20 may be formed of sheet metal, or may be formed of a resin material.

Emitter

The light emitter 70 has a function of emitting light to +H side. The light emitter 70 in the present exemplary embodiment is a vertical cavity surface emitting laser (VCSEL) device mounted on a wiring substrate, and is mounted on the upper surface 22 of the base material 20 (see FIG. 2). That is, the light emitter 70 is disposed at the upper surface 22 of the base material 20. As illustrated in FIG. 1, when viewed in the device up-down direction, the light emitter 70 has a rectangular shape smaller than the base material 20. The light emitter 70 has a lower stiffness than the base material 20. Specifically, the base material 20 has a higher bending stiffness in the H direction, and higher tensile, compressive stiffness in the W direction and D direction than the light emitter 70. The light emitter 70 has an increased stiffness in each of the above-mentioned directions by being mounted on the base material 20, as compared with when the light emitter 70 is singly provided.

The operation of the light emitter 70 is controlled by the controller 50. In addition, the light emitter 70 generates heat due to its light emission. The heat generated due to light emission of the light emitter 70 is transmitted to the upper surface 22 of the base material 20, and the heat is released. In other words, the light emitter 70 reduces excessive heat by releasing heat through the base material 20. In still other words, the light emitter 70 heats the upper surface 22 of the base material 20 due to light emission.

Heater

The heater 30 is a thin plate-shaped electric heater which is mounted on the lower surface 24 of the base material 20 and has a function of heating the lower surface 24 by energization. That is, the heater 30 has a function of heating the base material 20 from the lower surface 24. The heater 30 is disposed at the lower surface 24 of the base material 20. When viewed in the device up-down direction, the heater 30 has a rectangular shape smaller than the base material 20 and larger than the light emitter 70, and the light emitter 70 is disposed to be located inside the heater 30. In other words, the position of the heater 30 in the horizontal direction overlaps with the light emitter 70. Specifically, the position of the heater 30 in the device width direction overlaps with the light emitter 70. Furthermore, the position of the heater 30 in the device width direction overlaps with part of the light emitter 70. In addition, the position of the heater 30 in the device depth direction overlaps with the light emitter 70. Furthermore, the position of the heater 30 in the device depth direction overlaps with part of the light emitter 70. The operation of the heater 30 is controlled by the controller 50.

Detector

The detector 40 has a function of detecting the temperature of the base material 20. As illustrated in FIG. 2, the detector 40 is configurated to include an upper-side detector 42, and a lower-side detector 44. The upper-side detector 42 is a temperature sensor mounted on the upper surface 22 of the base material 20, and has a function of detecting the temperature of the upper surface 22 of the base material 20. That is, the detector 40 detects the temperature at the upper surface 22 of the base material 20. The lower-side detector 44 is a temperature sensor mounted on the lower surface 24 of the base material 20, and has a function of detecting the temperature of the lower surface 24 of the base material 20. That is, the detector 40 detects the temperature at the lower surface 24 of the base material 20.

Figure 3:
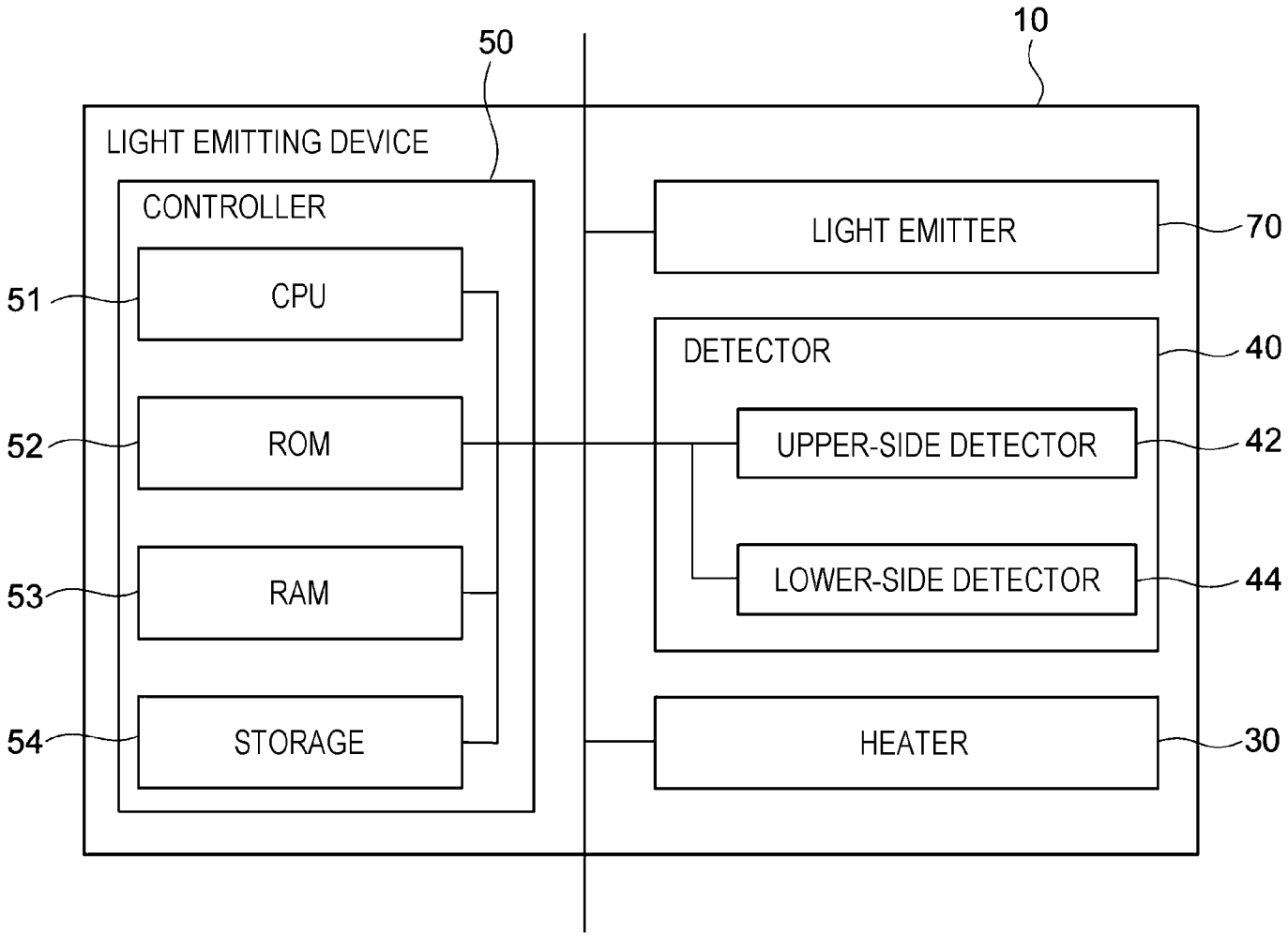
FIG. 3 is a block diagram illustrating the hardware configuration of the light emitting device according to the first exemplary embodiment.

FIG. 3 is a block diagram illustrating the hardware configuration of the light emitting device 10. In the light emitting device 10, the light emitter 70, the heater 30, the detector 40, and the controller 50 are coupled to each other via a bus to enable mutual communication.

Controller

As illustrated in FIG. 3, the controller 50 includes a central processing unit (CPU) 51, a read only memory (ROM) 52, a random access memory (RAM) 53, and a storage 54. The CPU 51 is a central arithmetic processing unit that executes various programs, and controls the components.

Figure 15:
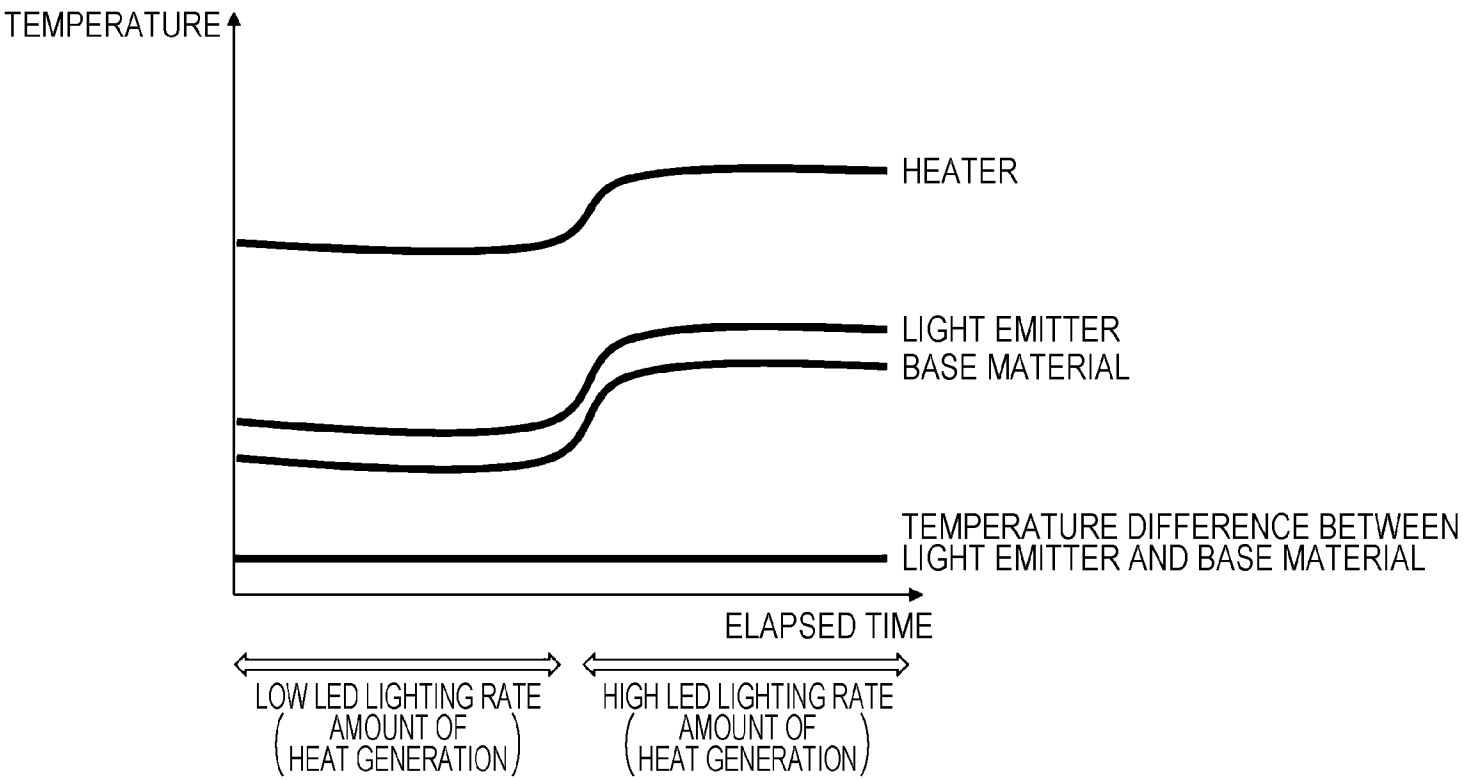
FIG. 15 is a graph illustrating a relationship between time and temperature at some components when the temperature of a heater is controlled in response to temperature change of a light emitter by executing a temperature difference control program.

Specifically, the CPU 51 reads a program from the ROM 52 or the storage 54, and executes the program using the RAM 53 as a work area. The CPU 51 performs control on the above-mentioned components and various types of arithmetic processing in accordance with a program recorded in the ROM 52 or the storage 54. In the present exemplary embodiment, the ROM 52 or the storage 54 stores a temperature difference control program that causes the heater 30 to operate so as to reduce the temperature difference between the temperature of the upper surface 22 and the temperature of the lower surface 24 which are detected by the detector 40. Due to this program, the controller 50 has a function of controlling the heater 30 based on results of detection of the detector 40. Note that FIG. 15 illustrates a graph, as an example, which indicates a relationship between time (elapsed time) and temperature at each of several components when the temperature of the heater 30 is controlled with respect to the temperature of the light emitter 70 by executing the temperature difference control program.

Figure 16:
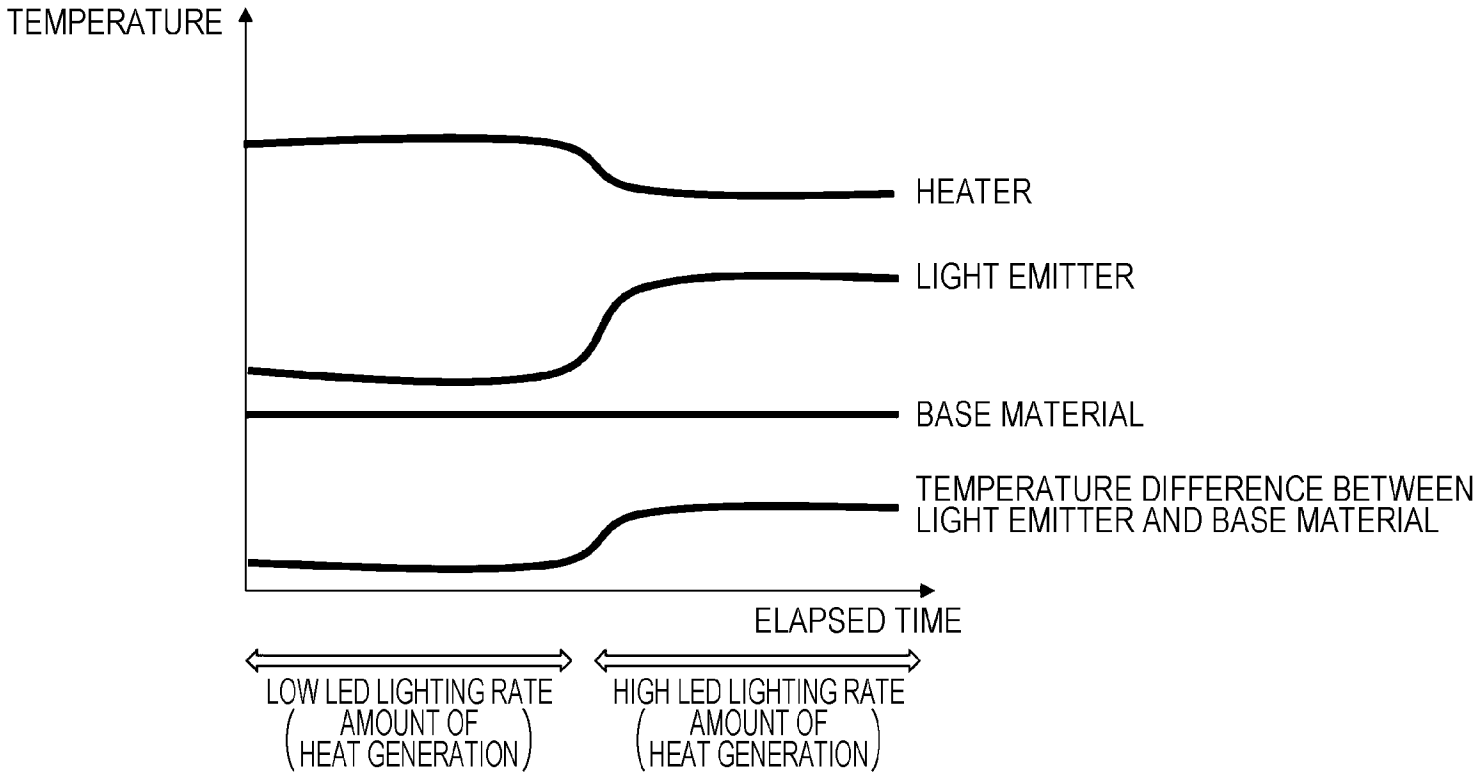
FIG. 16 is a graph illustrating a relationship between time and temperature at some components when the temperature of a heater is controlled in response to temperature change of a light emitter by executing a temperature control program.

In the present exemplary embodiment, the heater 30 is operated so that the temperature difference between the temperature of the upper surface 22 and the temperature of the lower surface 24 is reduced; however, the present disclosure is not limited to this configuration. For example, in another exemplary embodiment, the ROM 52 or the storage 54 stores a temperature control program which causes the heater 30 to operate so that the temperature of the base material 20 reaches a predetermined target temperature. The controller 50 may control the heater 30 by the program so that the temperature of the base material 20 reaches a predetermined target temperature. Note that FIG. 16 illustrates a graph, as an example, which indicates a relationship between time (elapsed time) and temperature at each of several components when the temperature of the heater 30 is controlled with respect to the temperature of the light emitter 70 by executing the temperature control program.

The ROM 52 stores various programs and various data. The RAM 53 serving as a work area temporarily stores programs or data. The storage 54 is comprised of a hard disk drive (HDD) or a solid state drive (SSD), and stores various programs including an operating system, and various data.

Operation and Effect

Next, the operation and effect of an optical device 10 of the first exemplary embodiment will be described. Note that in this description, when an embodiment is described in comparison with the first exemplary embodiment, and the same components as in the light emitting device 10 are used, the symbols and names of the components are used as they are.

First, the light emitting device will be described, in which the light emitter 70 is disposed at the upper surface 22 of the base material 20. In the light emitting device, when the light emitter 70 emits light, part of the base material 20 on the upper surface 22 is heated and thermally expanded by heat generation due to light emission of the light emitter 70. In contrast, part of the base material 20 at the lower surface 24 away from the light emitter 70 is more unlikely to be heated, and thermally expanded by the light emitter 70 than part of the base material 20 at the upper surface 22. Thus, in the light emitting device in which the light emitter 70 is disposed at the upper surface 22 of the base material 20, when the light emitter 70 emits light, the base material 20 is thermally deformed by heat generation due to light emission of the light emitter 70.

In contrast, the light emitting device 10 of the present exemplary embodiment includes the heater 30 disposed at the lower surface 24 of the base material 20, thus part of the base material 20 at the lower surface 24 can be heated by the heater 30. Thus, with the light emitting device 10, part of the base material 20 at the upper surface 22 and part of the base material 20 at the lower surface 24 can be heated, and thermally expanded by the light emitter 70 and the heater 30, respectively. Thus, the light emitting device 10 can reduce thermal deformation of the base material 20 due to heat generation of the light emitter 70. Particularly, as compared with a configuration in which the heater 30 is disposed only between the base material 20 and the light emitter 70, the light emitting device 10 can reduce thermal deformation of the base material 20 due to heat generation of the light emitter 70.

In addition, the light emitting device 10 of the present exemplary embodiment further includes a detector 40 that detects the temperature of the base material 20, and a controller 50 that controls the heater 30 based on results of detection of the detector 40. Thus, the light emitting device 10 of the present exemplary embodiment can adjust the amount of heating by the heater 30 based on results of detection of the detector 40, as compared with when the heater 30 is controlled based on the amount of light emission by the light emitter 70. Thus, the light emitting device 10 of the present exemplary embodiment can reduce thermal deformation of the base material 20 due to heat generation of the light emitter 70, as compared with when the heater 30 is controlled based on the amount of light emission by the light emitter 70.

In addition, in the light emitting device 10 of the present exemplary embodiment, the detector 40 has the lower-side detector 44 that detects the temperature of the lower surface 24 of the base material 20. Thus, the light emitting device 10 of the present exemplary embodiment can control the heater 30 by the controller 50 based on the detection result of the temperature at the lower surface 24 of the base material 20.

In addition, the light emitting device 10 of the present exemplary embodiment further has the upper-side detector 42 that detects the temperature of the upper surface 22 of the base material 20. Thus, the light emitting device 10 of the present exemplary embodiment can control the heater 30 by the controller 50 based on the detection result of the temperature of each of the upper surface 22 and the lower surface 24 of the base material 20.

In the light emitting device 10 of the present exemplary embodiment, the position of the heater 30 in the horizontal direction overlaps with the light emitter 70. Thus, the light emitting device 10 can heat the lower surface 24 of the base material 20 by the heater 30 symmetrically with a heated range of the upper surface 22 of the base material 20 in the device up-down direction, the heated range being caused by light emission of the light emitter 70. Thus, the light emitting device 10 of the present exemplary embodiment can reduce thermal deformation of the base material 20 due to heat generation of the light emitter 70, as compared with a configuration in which the entire heater 30 is displaced from the light emitter 70 in the horizontal direction.

In the light emitting device 10 of the present exemplary embodiment, the light emitter 70 is mounted on the upper surface 22 of the base material 20. Thus, the light emitting device 10 of the present exemplary embodiment can transmit the heat generated due to light emission of the light emitter 70 to the base material 20, as compared with a configuration in which the light emitter 70 is disposed at a predetermined position away from the base material 20 above the base material 20. In other words, the light emitting device 10 of the present exemplary embodiment can promote heat release from the light emitter 70, as compared with a configuration in which the light emitter 70 is not mounted on the upper surface 22 of the base material 20.

In the configuration in which the light emitter 70 is mounted on the upper surface 22 of the base material 20, when the upper surface 22 of the base material 20 is heated and thermally deformed by heat generation due to light emission of the light emitter 70, the light emitter 70 may be deformed in a similar manner as the thermally deformed upper surface 22 of the base material 20. In the configuration in which the light emitter 70 is mounted on the upper surface 22 of the base material 20, the light emitting device 10 of the present exemplary embodiment further includes the heater 30. Thus, in the configuration in which the light emitter 70 and the heater 30 are included, the light emitting device 10 of the present exemplary embodiment can reduce deformation the light emitter 70 due to thermal deformation of the base material 20 while promoting heat release from the light emitter 70, as compared with a configuration in which the light emitter 70 is not mounted on the upper surface 22 of the base material 20.

Second Exemplary Embodiment

Next, an exposure device 110 and an image forming apparatus 100 according to a second exemplary embodiment of the present disclosure will be described with reference to FIG. 4 to FIG. 9.

Note that in the description below, in a front view of the image forming apparatus 100 from the side where a user (not illustrated) stands, a device up-down direction (vertical direction), a device width direction (horizontal direction), and a device depth direction (horizontal direction) are denoted by H direction, W direction, and D direction, respectively. When it is necessary to distinguish between one side and the other side of each of the device up-down direction, the device width direction, and the device depth direction, in a plan view of the image forming apparatus 100, the upper side, the lower side, the right side, the left side, the depth side, and the near side are denoted by +H side, −H side, +W side, −W side, −D side, +D side, respectively.

Image Forming Apparatus

Figure 4:
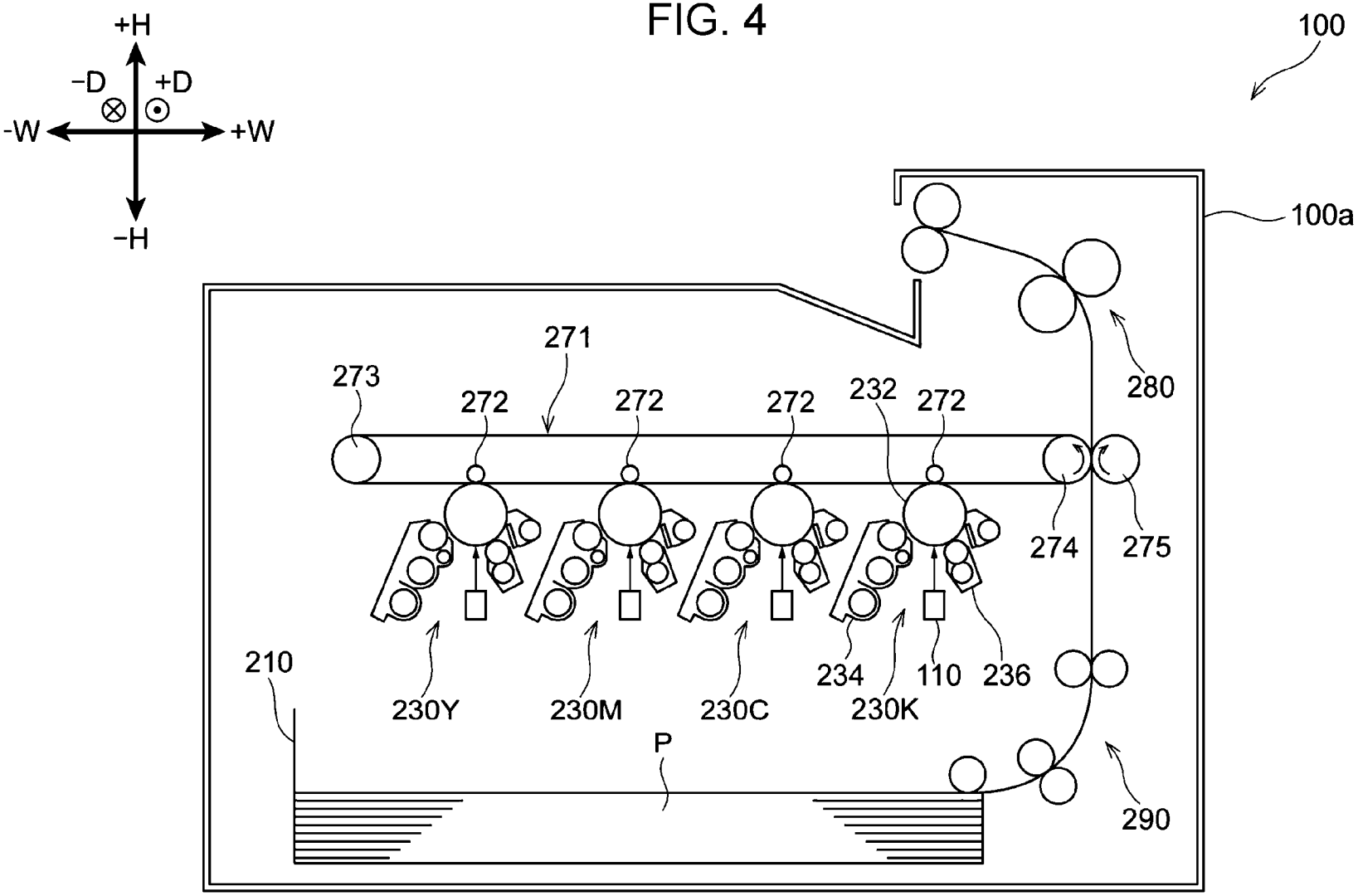
FIG. 4 is a schematic front view illustrating the configuration of an image forming apparatus according to a second exemplary embodiment.

The image forming apparatus 100 according to the second exemplary embodiment is an electrophotographic image forming apparatus that forms and fixes a toner image on a sheet member P which is an example of a recording medium. As illustrated in FIG. 4, the image forming apparatus 100 includes a housing 100*a*, a storage 210, a transporter 290, a former 220, a fixer 280, and a controller 150 (not illustrated). The storage 210 stores the sheet member P. The transporter 290 transports the sheet member P stored in the storage 210 to the former 220. The housing 100*a* stores the components of the image forming apparatus 100. The controller 150 controls the operation of each component of the image forming apparatus 100. The details of the controller 150 will be described below.

The former 220 has photoconductor units 230Y, 230M, 230C, 230K, and a transfer unit 270. Note that respective symbol subscripts show that "Y" is for yellow, "M" is for magenta, "C" is for cyan, and "K" is for black.

The photoconductor units 230Y to 230K (230Y, 230M, 230C, 230K) are disposed inside the housing 100*a* in a state of being arranged as viewed from the front of the image forming apparatus 100. The photoconductor units 230Y, 230M, 230C, 230K are configured in the same manner except for the toner to be used. Thus, symbols representing the components of a photoconductor unit are given for the photoconductor unit 230K, and omitted for the photoconductor units 230Y, 230M, 230C.

The photoconductor units 230Y to 230K each include a photoconductor drum 232, a developing device 234, an exposure device 110, and a charging device 236. The photoconductor drum 232 is an example of an image carrier having an outer circumferential surface on which an electrostatic latent image is formed. The photoconductor drum 232 is provided rotatably around an axis in the front view direction of the image forming apparatus 100, and is rotated by a motor (not illustrated) clockwise as viewed from the front of the image forming apparatus 100. The charging device 236 charges the outer circumferential surface of the photoconductor drum 232 to a predetermined potential. The exposure device 110 radiates light onto the photoconductor drum 232 to form an electrostatic latent image, the photoconductor drum 232 being disposed on +H side with respect to the exposure device 110 and charged by the charging device 236. The exposure device 110 is an example of a light emitting device. The developing device 234 forms a toner image by developing the electrostatic latent image formed on the photoconductor drum 232 using the developer containing toner. Note that the details of the exposure device 110 will be described below.

The transfer unit 270 includes an intermediate transfer belt 271, multiple first transfer rollers 272, a drive roller 273, a secondary transfer roller 274, and an opposing roller 275. The intermediate transfer belt 271 is an endless belt with an inner circumferential surface supported by the first transfer rollers 272, the drive roller 273, and the secondary transfer roller 274, and rotates counterclockwise by the drive roller 273 as viewed from the front of the image forming apparatus 100. The transfer unit 270 transfers toner images formed by the photoconductor units 230Y to 230K onto the sheet member P transported by the transporter 290 via the intermediate transfer belt 271, and transports the sheet member P with the transferred toner images to the fixer 280.

The fixer 280 fixes the transferred toner images onto the sheet member P, and discharges the sheet member P with the toner images fixed to the outside of the apparatus.

Exposure Device

Next, the exposure device 110 will be described.

Figure 7:
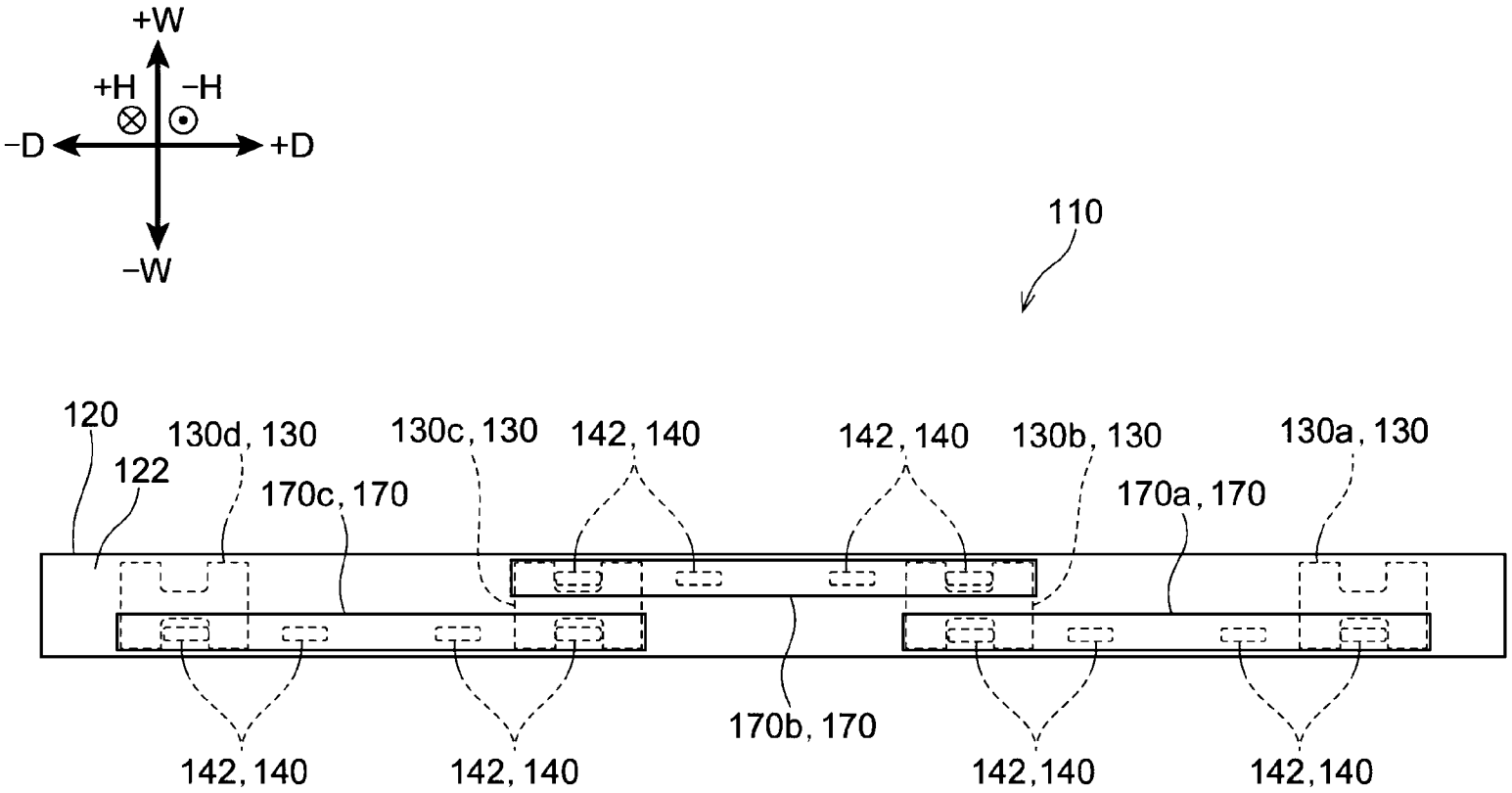
FIG. 7 is a plan view from above of the exposure device according to the second exemplary embodiment.
Figure 8:
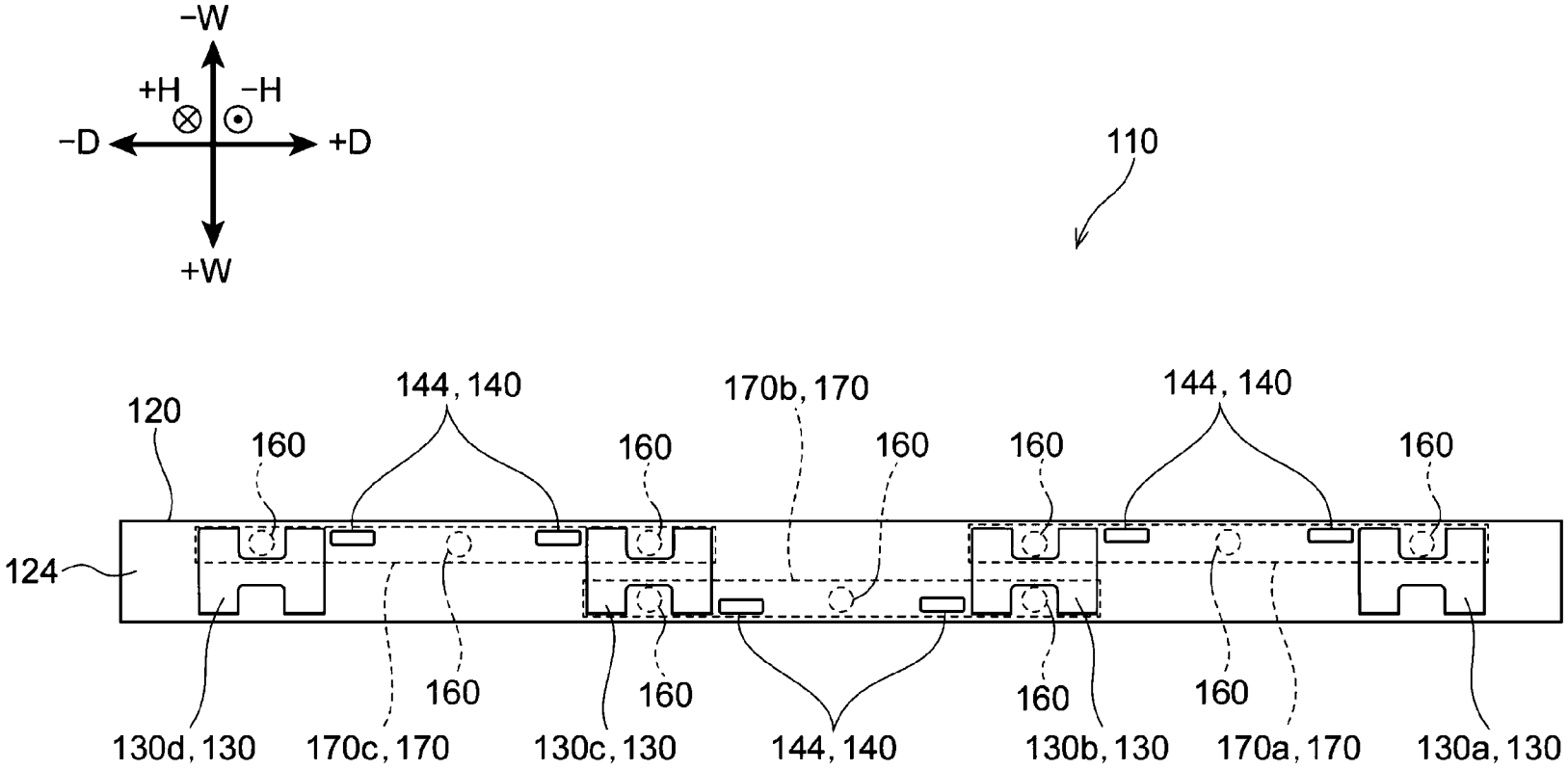
FIG. 8 is a plan view from below of the exposure device according to the second exemplary embodiment.
Figure 9:
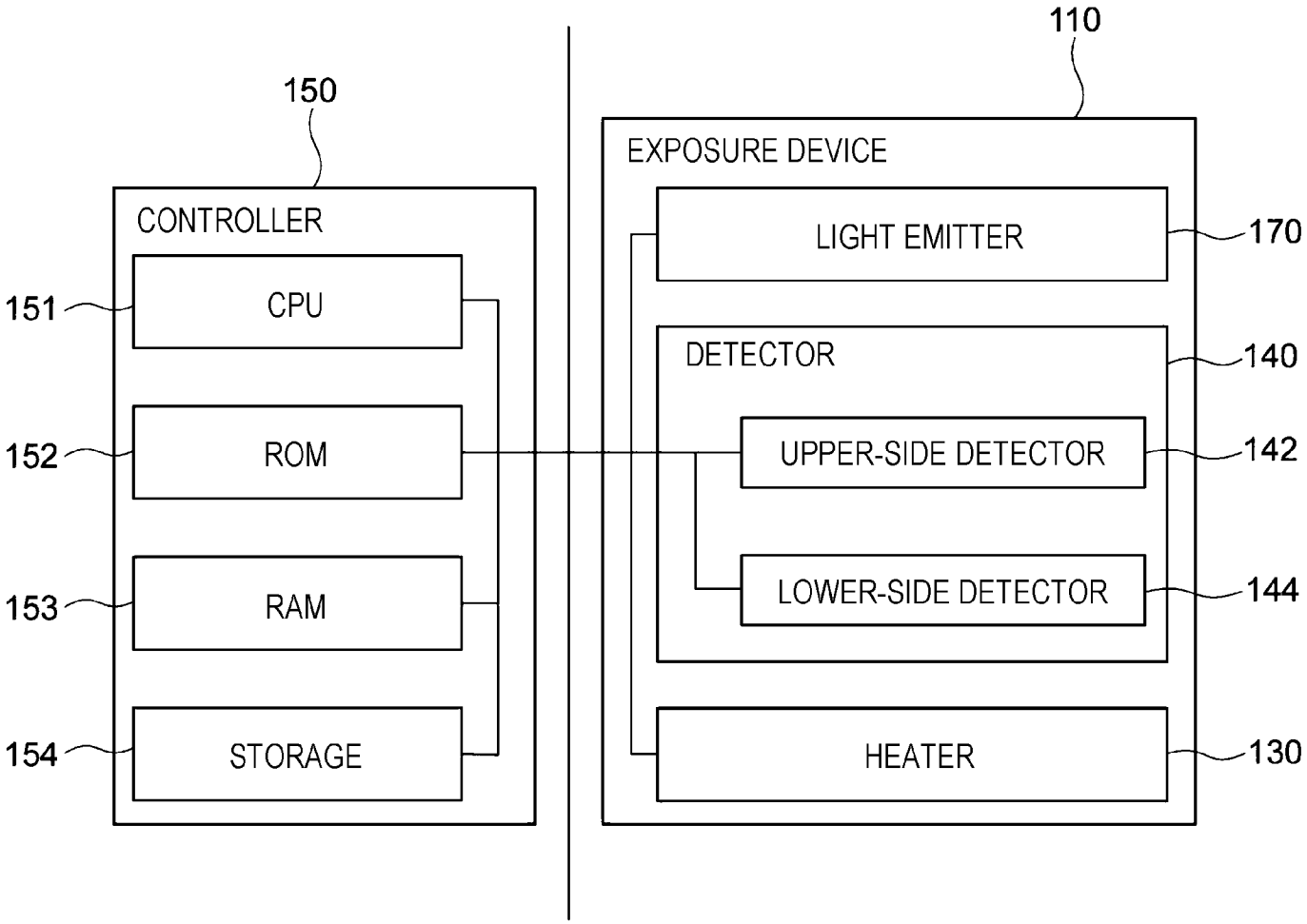
FIG. 9 is a block diagram illustrating the hardware configuration of the exposure device according to the second exemplary embodiment.

As illustrated in FIG. 5 to FIG. 8, the exposure device 110 includes a base material 120, multiple light emitters 170, and heaters 130. In the present exemplary embodiment, the exposure device 110 includes three light emitters 170. In addition, the exposure device 110 further includes detectors 140, spacers 160 and a covering part 112. As illustrated in FIG. 9, the exposure device 110 is coupled to the controller 150 via a bus to enable mutual communication. In other words, the exposure device 110 includes the controller 150.

Figure 5:
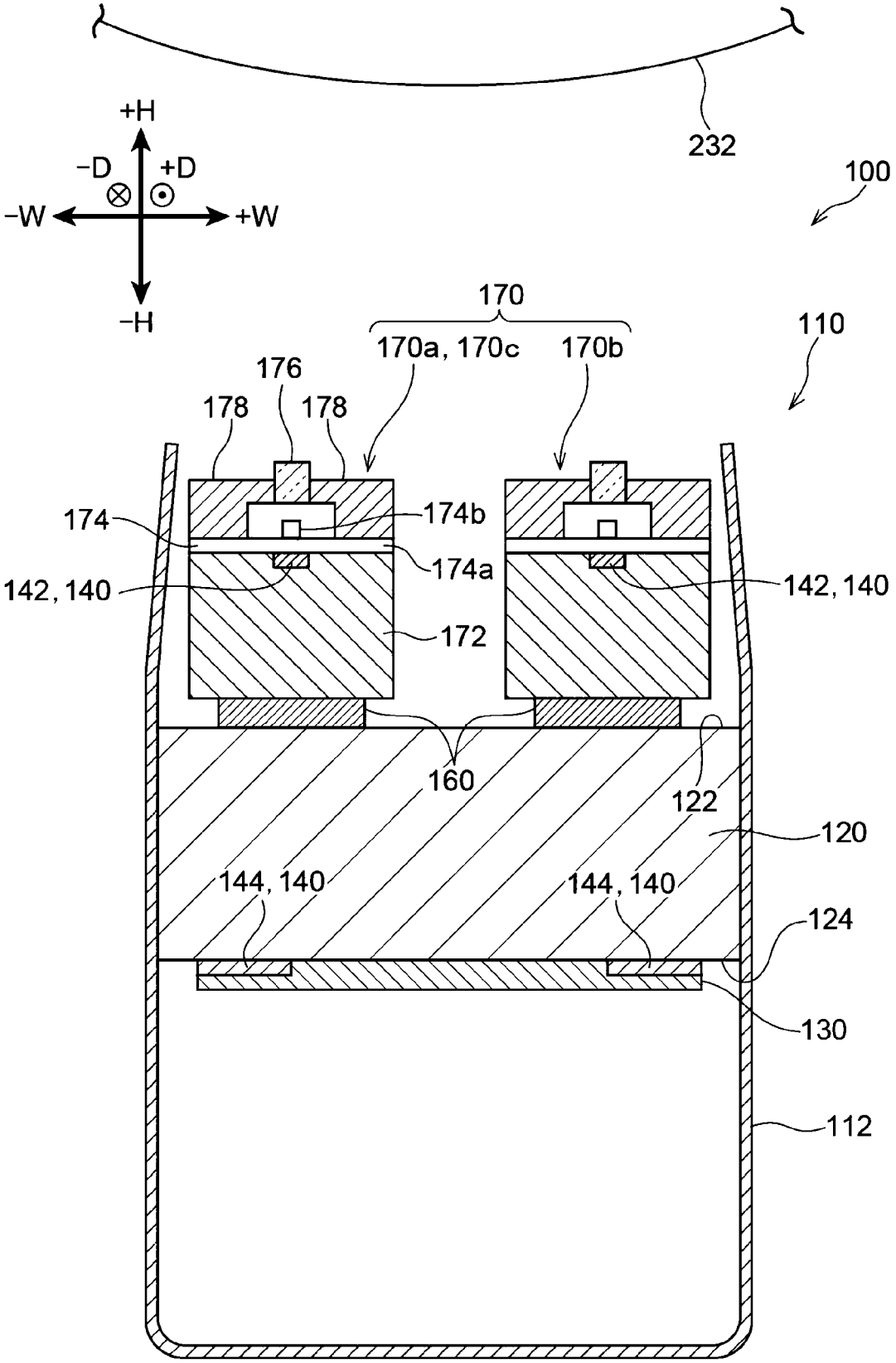
FIG. 5 is a front view illustrating the configuration of an exposure device according to the second exemplary embodiment.
Figure 6:
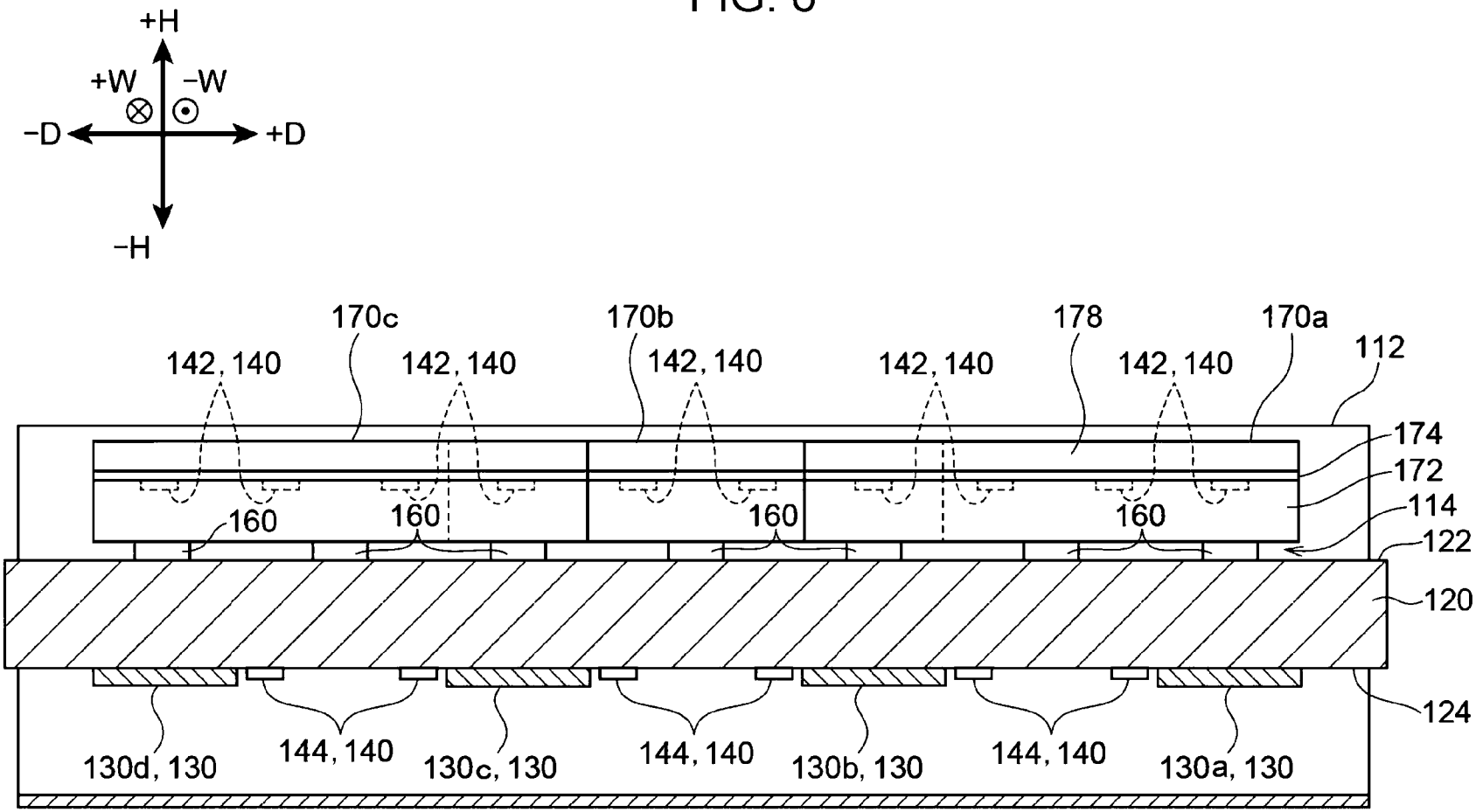
FIG. 6 is a cross-sectional side view illustrating the configuration of the exposure device according to the second exemplary embodiment.

As illustrated in FIG. 5 to FIG. 7, the base material 120 is a block material in a rectangular parallelepiped shape with the device depth direction in a longitudinal direction. The base material 120 is along D-W plane, and has an upper surface 122 facing +H side and a lower surface 124 facing −H side. The upper surface 122 is an example of a surface. The lower surface 124 is an example of another surface. The base material 120 is an example of a member. For example, the base material 120 is made of metal such as stainless steel, and has a higher stiffness than the later-described light emitter 170.

Note that the base material 120 in the present exemplary embodiment is not necessarily comprised of a metal block as long as the base material 120 has a higher stiffness than the light emitter 170. For example, the base material 120 may be comprised of sheet metal, or may be comprised of a resin material.

Light Emitter

Three light emitters 170 each have a function of emitting light to +H side. As illustrated in FIG. 7, three light emitters 170 extend in the longitudinal direction (device depth direction) of the base material 120, and mounted via the later-described spacers 160 in a zigzag pattern along the longitudinal direction (device depth direction) of the base material 120. In other words, the three light emitters 170 are disposed in a state of being separated from the upper surface 122. The three light emitters 170 are referred to as light emitters 170*a*, 170*b*, 170*c* from +D side. In the present exemplary embodiment, the light emitters 170*a* and 170*c* are disposed on −W side with respect to the light emitter 170*b*.

For each of the three light emitters 170, the end of at least one side in the device depth direction overlaps in position with the end of at least the other side in the device depth direction of another light emitter 170 adjacent to the light emitter 170. Specifically, as illustrated in FIG. 7, the light emitter 170*a* and the light emitter 170*b* are disposed so as to overlap each other in part as viewed in the device width direction. Specifically, the end of the light emitter 170*a* on −D side overlaps in position with the end of the light emitter 170*b* on +D side in the device depth direction. The light emitter 170*c* and the light emitter 170*b* are disposed so as to overlap each other in part as viewed in the device width direction. Specifically, the end of the light emitter 170*c* on +D side overlaps in position with the end of the light emitter 170*b* on −D side in the device depth direction.

The light emitters 170*a*, 170*b*, 170*c* have the same configuration. For this reason, the symbols representing the components of the light emitters 170 are given to the light emitter 170*a*, and symbols for the light emitters 170*b* and 170*c* are omitted.

As illustrated in FIG. 5 and FIG. 6, the light emitter 170*a* includes a base material 172, a light emitting substrate 174, a lens part 176, and a lens retainer 178.

The base material 172 is a block material in a rectangular parallelepiped shape with the device depth direction in a longitudinal direction. The base material 172 is made of metal such as stainless steel, for example.

As illustrated in FIG. 5 to FIG. 7, the base material 172 has recessed portions 172*a* in which the later-described upper-side detectors 142 of the detectors 140 are disposed. The recessed portions 172*a* are recesses depressed on the upper surface of the base material 172, and are formed side by side with spaces therebetween in the longitudinal direction (device depth direction) of the base material 120. In the present exemplary embodiment, four recessed portions 172*a* are formed for one base material 172.

The light emitting substrate 174 has a function of emitting light to +H side. The light emitting substrate 174 has a thin plate-shaped substrate 174*a* which spreads along the upper surface of the base material 172 extending in the device depth direction, and a light source 174*b* disposed on the upper surface of the substrate 174*a* in the device depth direction. The light source 174*b* in the present exemplary embodiment is a light emitting device array having a semiconductor substrate, and light emitting devices, such as multiple light emitting diodes, light emission thyristors, or laser devices formed on the semiconductor substrate in the device depth direction. Note that the light source 174*b* is not necessarily a light emitting device array, and may be a single light emitting device.

The lens part 176 is a lens array which is disposed on +H side with respect to the light source 174*b* of the light emitting substrate 174, and extends in the device depth direction. The lens part 176 has a rectangular shape as viewed in the device depth direction, and has a function of allowing the light radiated from the light source 174*b* to enter the surface on −H side, and emitting the light to the surface of the photoconductor drum 232 from the surface on +H side. The lens part 176 is disposed at a predetermined relative position with respect to the light source 174*b*.

The lens retainer 178 is disposed on the upper surface of the light emitting substrate 174, and has a function of retaining the lens part 176 in a state of being interposed in the device width direction.

The light emitter 170*a* has a lower stiffness than the base material 120. Specifically, the base material 120 has a higher bending stiffness in the device up-down direction and the device width direction, and higher tensile, compressive stiffness in the device width direction and the device depth direction than the light emitter 170*a*. The light emitter 170*a* has an increased stiffness in each of the above-mentioned directions by being mounted on the base material 120, as compared with when the light emitter 170*a* is singly provided.

The operation of the light emitter 170 is controlled by the controller 150. In addition, the light emitter 170 generates heat due to its light emission. The generated heat due to light emission of the light emitter 170 is transmitted to the upper surface 122 of the base material 120 via the spacers 160, and is radiated to the upper surface 122 through the later-described gap 114, and the heat is released. In other words, the light emitter 170 reduces excessive heat by releasing heat through the base material 120. In still other words, the light emitter 170 heats the upper surface 122 of the base material 120 due to light emission.

Spacer

As illustrated in FIG. 5 and FIG. 6, the spacers 160 are each a circular plate having an axial direction in the device up-down direction and being mounted on the upper surface 122 of the base material 120 to support the light emitter 170 from below. In other words, each spacer 160 is disposed to be interposed between the base material 120 and the light emitter 170 in the device up-down direction. The spacer 160 is an example of a connector. The diameter of the spacer 160 is shorter than the length of the base material 120 in the device width direction. As illustrated in FIG. 6, the spacers 160 are arranged side by side at intervals in the longitudinal direction (device depth direction) of the light emitter 170. In the present exemplary embodiment, three spacers 160 are disposed for one light emitter 170. Thus, a gap 114 is formed between the light emitter 170 and the base material 120. Specifically, since the spacer 160 is disposed between the base material 120 and the light emitter 170, the gap 114 is formed between the lower surface of the base material 172 of the light emitter 170 and the upper surface 122 of the base material 120.

In the present exemplary embodiment, the three spacers 160 for one light emitter 170 are disposed so as to support both ends of the base material 120 of the light emitter 170 in the device depth direction, and the central part of the base material 120 in the device depth direction.

Heater

The heaters 130 are each a thin plate-shaped electric heater which is mounted on the lower surface 124 of the base material 120 and has a function of heating the lower surface 124 by energization. That is, each heater 130 has a function of heating the base material 120 from the lower surface 124. The heater 130 is disposed at the lower surface 124 of the base material 120. As illustrated in FIG. 8, the heaters 130 each have an H-shaped surface standing in the device width direction as viewed in the device up-down direction, and are arranged side by side at intervals in the longitudinal direction (device depth direction) of the lower surface 124. In the present exemplary embodiment, four heaters 130 are disposed. The four heaters 130 are referred to as heaters 130*a*, 130*b*, 130*c*, 130*d* from +D side. The operation of the four heaters 130 is controlled by the controller 50.

The four heaters 130*a* to 130*d* (130*a*, 130*b*, 130*c*, 130*d*) are disposed so as to overlap with part of three light emitters 170 as viewed in the device up-down direction. In other words, the heaters 130 are disposed so as to overlap in position with part of the light emitter 170 in the device depth direction. Specifically, the heater 130*a* is disposed so that part thereof on −W side overlaps with the end of the emitter 170*a* on +D side as viewed in the device up-down direction. In addition, the heater 130*b* is disposed so that part thereof on −W side overlaps with the end of the emitter 170*a* on −D side as viewed in the device up-down direction. The heater 130*b* is disposed so that part thereof on +W side overlaps with the end of the emitter 170*b* on +D side as viewed in the device up-down direction. The heater 130*c* is disposed so that part thereof on +W side overlaps with the end of the emitter 170*b* on −D side as viewed in the device up-down direction. The heater 130*c* is disposed so that part thereof on −W side overlaps with the end of the emitter 170*c* on +D side as viewed in the device up-down direction. The heater 130*d* is disposed so that part thereof on −W side overlaps with the end of the emitter 170*c* on −D side as viewed in the device up-down direction.

The position of the heater 130 in the device depth direction overlaps with the spacers 160. Specifically, the heaters 130*a* to 130*d* are each disposed so as to overlap in position with part of the spacers 160 in the device depth direction.

More specifically, the heater 130*a* is disposed so as to overlap in position with the spacer 160 disposed at the end of the emitter 170*a* on +D side in the device depth direction. The heater 130*b* is disposed so as to overlap in position with the spacer 160 placed at the end of the emitter 170*a* on −D side in the device depth direction. The heater 130*b* is disposed so as to overlap in position with the spacer 160 placed at the end of the emitter 170*b* on +D side in the device depth direction. The heater 130*c* is disposed so as to overlap in position with the spacer 160 placed at the end of the emitter 170*b* on −D side in the device depth direction. The heater 130*c* is disposed so as to overlap in position with the spacer 160 placed at the end of the emitter 170*c* on +D side in the device depth direction. The heater 130*c* is disposed so as to overlap in position with the spacer 160 placed at the end of the emitter 170*c* on −D side in the device depth direction.

Detector

As illustrated in FIG. 5, the detectors 140 each includes an upper-side detector 142 and a lower-side detector 144.

The upper-side detector 142 is a temperature sensor disposed at each of multiple recessed portions 172*a* formed in the base material 172 of the light emitter 170, and has a function of detecting the temperature of the light emitter 170. That is, the upper-side detector 142 of the detector 140 detects the temperature at the upper surface 122 of the base material 120. In the present exemplary embodiment, as illustrated in FIG. 7, the upper-side detector 142 is disposed at each of four recessed portions 172*a* formed for each of three light emitters 170.

The lower-side detector 144 is a temperature sensor disposed on the lower surface 124 of the base material 120, and has a function of detecting the temperature of the lower surface 124 of the base material 120. That is, the lower-side detector 144 of the detector 140 detects the temperature at the lower surface 124 of the base material 120. In the present exemplary embodiment, as illustrated in FIG. 8, six lower-side detectors 144 are disposed on the lower surface 124 of the base material 120. Specifically, six lower-side detectors 144 are disposed as pairs of two (three pairs in total) in a zigzag pattern extending in the device depth direction so as to overlap with three light emitters 170 disposed in a zigzag pattern extending in the device depth direction as viewed in the device up-down direction.

FIG. 9 is a block diagram illustrating the hardware configuration of the exposure device 110. In the exposure device 110, a light emitter 170, a heater 130, a detector 140, and a controller 150 are coupled to each other via a bus to enable mutual communication. Note that although the light emitter 170 has multiple light emitters 170*a* to 170*b*, for the sake of simplification, those multiple light emitters are collectively illustrated as the light emitter 170 in FIG. 9. Similarly, the heater 130 (heaters 130*a* to 130*d*), the upper-side detector 142, the lower-side detector 144 are respectively collectively illustrated for the sake of simplification in FIG. 9.

Controller

As illustrated in FIG. 9, the controller 150 includes a CPU 151, a ROM 152, a RAM 153, and a storage 154. The CPU 151 is a central arithmetic processing unit that executes various programs, and controls the components.

Specifically, the CPU 151 reads a program from the ROM 152 or the storage 154, and executes the program using the RAM 153 as a work area. The CPU 151 performs control on the above-mentioned components and various types of arithmetic processing in accordance with a program recorded in the ROM 152 or the storage 154. In the present exemplary embodiment, the ROM 152 or the storage 154 stores a temperature distribution calculation program that calculates the temperature distribution inside the base material 120 from results of detection by the detector 140 of the temperature of the upper surface 22 and the temperature of the lower surface 24 of the base material 120. In addition, the ROM 152 or the storage 154 stores a temperature difference control program that causes the heater 130 to operate so as to reduce the temperature difference inside the base material 120 based on the result of calculation of the temperature distribution calculation program. Thus, the difference in the amount of thermal expansion between the light emitter 170 and the base material 120, chiefly, variation in the joint position in the longitudinal direction is reduced. In another exemplary embodiment, the ROM 152 or the storage 154 stores a temperature control program that causes the heater 130 to operate so that the internal temperature of the base material 120 reaches a defined target temperature based on the result of calculation of the temperature distribution calculation program. The controller 150 may have a function of controlling the heater 130 by these programs based on the result of the detection by the detector 140. In this case, thermal expansion of the base material 120, chiefly, variation in the joint position in the transverse direction is reduced.

The ROM 152 stores various programs and various data. The RAM 153 serving as a work area temporarily stores programs or data. The storage 154 is comprised of a HDD or an SSD, and stores various programs including an operating system, and various data.

Others

As illustrated in FIG. 5, the covering part 112 has a U-shaped cross section as viewed in the device depth direction, and is a panel-shaped cover body mounted on the base material 120 to cover the base material 120 from below, and interpose the base material 120 in the device width direction. As illustrated in FIG. 6, the covering part 112 extends in the device width direction. As illustrated in FIG. 5, the covering part 112 is mounted on the base material 120 so that the bottom of the U-shape is away from the heater 130 in the device up-down direction. The covering part 112 forms a duct in the space enclosed between the lower surface 124 of the base material 120 and itself, the duct allowing flow of air sucked from the outside of the housing 100*a* by a fan which is not illustrated.

The covering part 112 covers each light emitter 170 in the W direction on the upper side of the upper surface 122. In addition, a gap as a thermal insulation layer is formed between the covering part 112 and each light emitter 170. Thus, radiation of the heat emitted by the light emitter 170 in the W direction is reduced, as compared with a configuration in which the covering part 112 is located only below the upper surface 122. The heat from the light emitter 170 is radiated, chiefly via the base material 120, to the air which flows through the above-mentioned duct.

The exposure device 110 radiates light onto the photoconductor drum 232 to form an electrostatic latent image, the photoconductor drum 232 being disposed on +H side with respect to the exposure device 110 and charged by the charging device 236.

Operation and Effect

Next, the operation and effect of the exposure device 110 and the image forming apparatus 100 of the second exemplary embodiment will be described. Note that in this description, when an embodiment is described in comparison with the second exemplary embodiment, and the same components as in the exposure device 110 and the image forming apparatus 100 are used, the symbols and names of the components are used as they are.

The exposure device 110 includes the heater 130 disposed on the lower surface 124 of the base material 120. Thus, the exposure device 110 of the second exemplary embodiment can provide the same effect as the first exemplary embodiment which includes the heater 30.

The exposure device 110 further includes the detector 140, and the controller 150. Thus, the exposure device 110 of the second exemplary embodiment can provide the same effect as the first exemplary embodiment which includes the detector 40, and the controller 50.

The exposure device 110 further has the lower-side detector 144 that detects the temperature at the lower surface 124 of the base material 120. Thus, the exposure device 110 of the second exemplary embodiment can provide the same effect as the first exemplary embodiment which includes the lower-side detector 44.

The exposure device 110 further has the upper-side detector 142 that detects the temperature at the upper surface 122 of the base material 120. Thus, the exposure device 110 of the second exemplary embodiment can provide the same effect as the first exemplary embodiment which includes the upper-side detector 42.

In the exposure device 110, the position of the heater 130 in the device depth direction overlaps with the light emitter 170. Thus, the exposure device 110 of the second exemplary embodiment can provide the same effect as the first exemplary embodiment in which the position of the heater 130 in the device depth direction overlaps with the light emitter 70.

In the exposure device 110, the light emitter 170 is mounted on the upper surface 122 of the base material 120. Thus, the exposure device 110 of the second exemplary embodiment can provide the same effect as the first exemplary embodiment in which the light emitter 70 is mounted on the upper surface 22 of the base material 20.

In addition, in the exposure device 110, the light emitter 170 is away from the upper surface 122 of the base material 120, and is mounted over the upper surface 122 via the spacer 160. The exposure device 110 of the present exemplary embodiment is compared with an exposure device 310 as a first comparison embodiment illustrated below.

The exposure device 310 of the first comparison embodiment does not have a component corresponding to the spacer 160 in the present exemplary embodiment, and the light emitter 170 is directly mounted so that the entire lower surface of the base material 172 is brought into contact with the upper surface 122 of the base material 120 without using the spacer 160. Except for the above-mentioned points, the exposure device 310 of the first comparison embodiment is configured in the same manner as the exposure device 110 of the present exemplary embodiment.

The heat transfer area between the light emitter 170 and the base material 120 of the exposure device 310 of the first comparison embodiment is greater than the heat transfer area of the exposure device 110 of the present exemplary embodiment. Thus, part of the base material 120 at the upper surface 122 is likely to thermally expand due to heat generation of the light emitter 170, as compared with the exposure device 110 of the present exemplary embodiment. That is, in the exposure device 310 of the first comparison embodiment, the base material 120 is more likely to be thermally deformed than in the exposure device 110 of the present exemplary embodiment.

In contrast, in the exposure device 110 of the present exemplary embodiment, the light emitter 170 is mounted over the upper surface 122 via the spacer 160, thus the heat transfer area between the light emitter 170 and the base material 120 is smaller than in the first comparison embodiment. Thus, in the exposure device 110 of the present exemplary embodiment, part of the base material 120 at the upper surface 122 is more unlikely to thermally expand due to heat generation of the light emitter 170 than in the first comparison embodiment. In addition, in the exposure device 110 of the present exemplary embodiment, the heat in the base material 120 higher in temperature than the light emitter 170 is more unlikely to be released to the light emitter 170 than in the first comparison embodiment. Thus, the exposure device 110 of the present exemplary embodiment can reduce thermal deformation of the base material 120 due to heat generation of the light emitter 170, as compared with a configuration in which the entire lower surface of the light emitter 170 is directly mounted on the base material 120.

In the exposure device 110, three spacers 160 are disposed at intervals in one light emitter 170. In the exposure device 110, the gap 114 is formed between the light emitter 170 and the upper surface 122 of the base material 120. Thus, in the exposure device 110, the heat transfer area between the light emitter 170 and the base material 120 is smaller, as compared with a configuration in which connectors are disposed in the entire space between the light emitter 170 and the upper surface 122. Thus, in the exposure device 110 of the present exemplary embodiment, part of the base material 120 at the upper surface 122 is unlikely to thermally expand due to heat generation of the light emitter 170, as compared with a configuration in which connectors are disposed in the entire space between the light emitter 170 and the upper surface 122. In the exposure device 110 of the exemplary embodiment, the heat in the base material 120 higher in temperature than the light emitter 170 is more unlikely to be released to the light emitter 170, as compared with a configuration in which connectors are disposed in the entire space between the light emitter 170 and the upper surface 122. Thus, the exposure device 110 of the present exemplary embodiment can reduce thermal deformation of the base material 120 due to heat generation of the light emitter 170, as compared with a configuration in which connectors are disposed in the entire space between the light emitter 170 and the upper surface 122.

In the exposure device 110, the heater 130 overlaps in position with the spacer 160 in the device depth direction. Thus, the exposure device 110 can heat the lower surface 124 of the base material 120 by the heater 130 correspondingly to a heated range on the upper surface 122 of the base material 120, the heated range being caused by light emission of the light emitter 170 via the spacer 160. Thus, the exposure device 110 of the present exemplary embodiment can reduce thermal deformation of the base material 120 due to heat generation of the light emitter 170, as compared with a configuration in which the entirety of the heater 130 is not aligned with the spacer 160 in the horizontal direction.

In addition, in the exposure device 110, four heaters 130 are disposed at intervals in the device depth direction. Consequently, the exposure device 110 of the present exemplary embodiment has a lighter weight, as compared with a configuration in which the exposure device 110 includes a heater overlapping with the entire light emitter 170 in the device depth direction.

In the exposure device 110, the base material 120 and the light emitter 170 extend in the device depth direction. Thus, since the heaters 130 are included in the exposure device 110 of the present exemplary embodiment, it is possible to reduce thermal deformation like bending of the base material 120 which extends in the device depth direction due to heat generation of the light emitter 170.

In the exposure device 110, three light emitters 170 are disposed in a zigzag pattern in the device depth direction. Thus, in the configuration in which three light emitters 170 are disposed in a zigzag pattern in the device depth direction, the exposure device 110 of the present exemplary embodiment can reduce thermal deformation of the base material 120 due to heat generation of the light emitter 170, as compared with a configuration in which the heaters are disposed only between the base material 120 and the light emitter 170.

In addition, the image forming apparatus 100 includes the exposure device 110 in which the heaters 130 are mounted on the base material 120. The image forming apparatus 100 of the present exemplary embodiment is compared with an image forming apparatus 300 as a second comparison embodiment illustrated below.

The image forming apparatus 300 of the second comparison embodiment has a configuration in which the base material 120 is heated using a hot air blower disposed outside the photoconductor units 230 instead of using the heaters 130 of the present exemplary embodiment. The hot air blower heats the base material 120 by sending hot air. The exposure device included in the image forming apparatus 300 of the second comparison embodiment does not have a component corresponding to the heater 130 of the present exemplary embodiment. Specifically, in the exposure device included in the image forming apparatus 300 of the second comparison embodiment, a heating unit to heat the base material 120 is not mounted on the base material 120. Except for the above-mentioned points, the image forming apparatus 300 of the second comparison embodiment is configured in the same manner as the image forming apparatus 100 of the present exemplary embodiment.

In the image forming apparatus 300 of the second comparison embodiment, the hot air blower is disposed outside the photoconductor units 230, and heats the base material 120 with hot air. Thus, in the image forming apparatus 300 of the second comparison embodiment, the hot air blower heats the developing device 234 and the photoconductor drum 232 of the photoconductor unit 230, in addition to the base material 120 of the exposure device 110. For this reason, in the image forming apparatus 300 of the second comparison embodiment, the hot air blower heats the developing device 234 and the photoconductor drum 232, thus heat may exert an adverse effect on toner images formed on the photoconductor drum 232 by the developing device 234.

In contrast, in the exposure device 110 of the exemplary embodiment, the heater 130 is mounted on the base material 120, thus heating to the base material 120 has less effect on the developing device 234 and the photoconductor drum 232, as compared with the exposure device of the second comparison embodiment. In addition, the exposure device 110 of the exemplary embodiment can reduce thermal deformation of the base material 120 due to heat generation of the light emitter 170, as compared with the exposure device 310 of the first comparison embodiment. Thus, the image forming apparatus 100 including the exposure device 110 of the present exemplary embodiment can control an image formation failure due to heat generation of the light emitter 170, as compared with the image forming apparatus including the exposure device 310 of the first comparison embodiment. Consequently, the image forming apparatus 300 of the exemplary embodiment can control an image formation failure due to heat generation of the light emitter 170 while reducing the effect of heating to the base material 120 on the developing device 234 and the photoconductor drum 232, as compared with a configuration including the exposure device of the second comparison embodiment.

Third Exemplary Embodiment

Next, a light emitting device 410 and an optical measurement device 400 according to a third exemplary embodiment of the present disclosure will be described with reference to FIG. 10 to FIG. 12.

Note that in the description below, the direction in which the optical measurement device 400 faces an object (not illustrated) of a measurement target is referred to as the near side in the device depth direction, and two directions orthogonal to each other and perpendicular to the device depth direction are referred to as a device up-down direction and a device width direction. In the drawings, the device up-down direction (vertical direction), the device width direction (horizontal direction), the device depth direction (horizontal direction) are denoted by H direction, W direction, and D direction, respectively. When it is necessary to distinguish between one side and the other side of each of the device up-down direction, the device width direction, and the device depth direction, in a front view of the optical measurement device 40, the upper side, the lower side, the right side, the left side, the depth side, and the near side are denoted by −H side, +H side, −W side, +W side, −D side, +D side, respectively.

Optical Measurement Device

The optical measurement device 400 according to the third exemplary embodiment is a measurement device that radiates light to an object (not illustrated) away from the optical measurement device 400 to +D side and receives light reflected from the object to identify the three-dimensional shape of the object (not illustrated). As illustrated in FIG. 11, the optical measurement device 400 includes a housing 400*a*, supporters 400*b*, a light emitting device 410, and a controller 450 (not illustrated).

The housing 400*a* stores the components of the optical measurement device 400. The housing 400*a* has two transparent plates 400*c*, 400*d*. The transparent plates 400*c*, 400*d* are each provided in part of the housing 400*a*, located on +D side of a light emitter 470 and a light receiver 480 of the later-described light emitting device 410. The transparent plate 400*c* allows light to pass through to the outside of the housing 400*a*, the light being radiated from the light emitter 470 to +D side. The transparent plate 400*d* allows light to pass through to the light receiver 480, the light being emitted to a user (not illustrated) and reflected from the user away from the light emitter 470 to +D side. The transmission plates 400*c*, 400*d* are comprised of a transparent material, such as glass or acrylic.

The supporters 400*b* are mounted on the housing 400*a*, and support the light emitting device 410 so as not to be in contact with the housing 400*a*. In the present exemplary embodiment, the supporters 400*b* support both ends of the later-described base material 420 of the light emitting device 410 in the device width direction. The controller 450 controls the operation of each component of the optical measurement device 400. The details of the controller 450 will be described below.

Light Emitting Device

The light emitting device 410 is a device that emits light to a user (not illustrated) away from the optical measurement device 400 to +D side. In other words, the light emitting device 410 is a device that radiates light to +D side. In addition, the light emitting device 410 further has a function of receiving light which has been radiated and reflected to and from a user (not illustrated). The light emitting device 410 includes a base material 420, a light emitter 470, and a heater 430. The light emitting device 410 further includes a detector 440, and a light receiver 480. In addition, the light emitting device 410 further includes a diffuser 412, and a lens part 414. As illustrated in FIG. 12, the light emitting device 410 is coupled to the controller 450 via a bus to enable mutual communication. In other words, the light emitting device 410 includes the controller 450.

Figure 10:
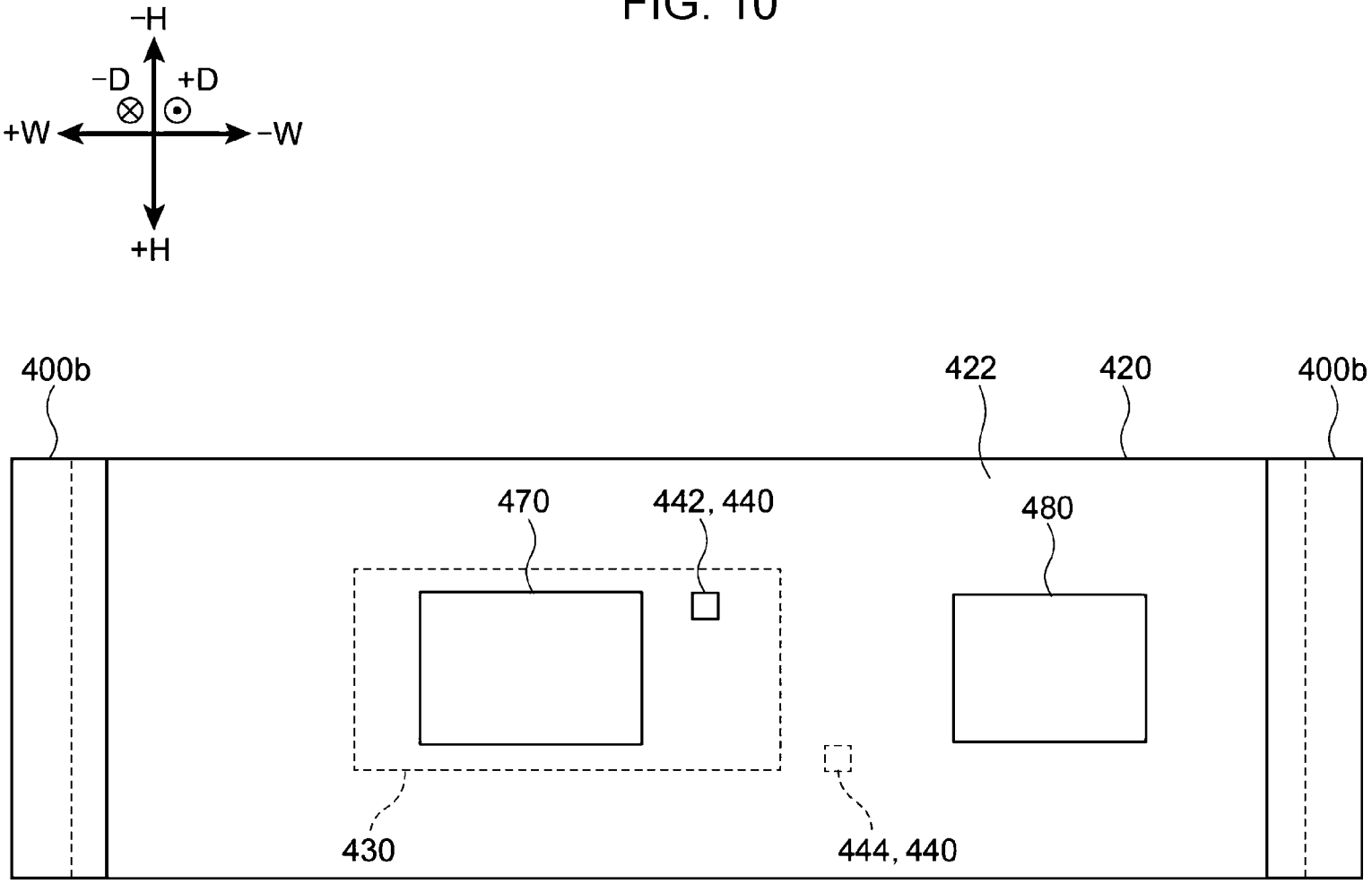
FIG. 10 is a front view illustrating the configuration of a light emitting device according to a third exemplary embodiment.
Figure 11:
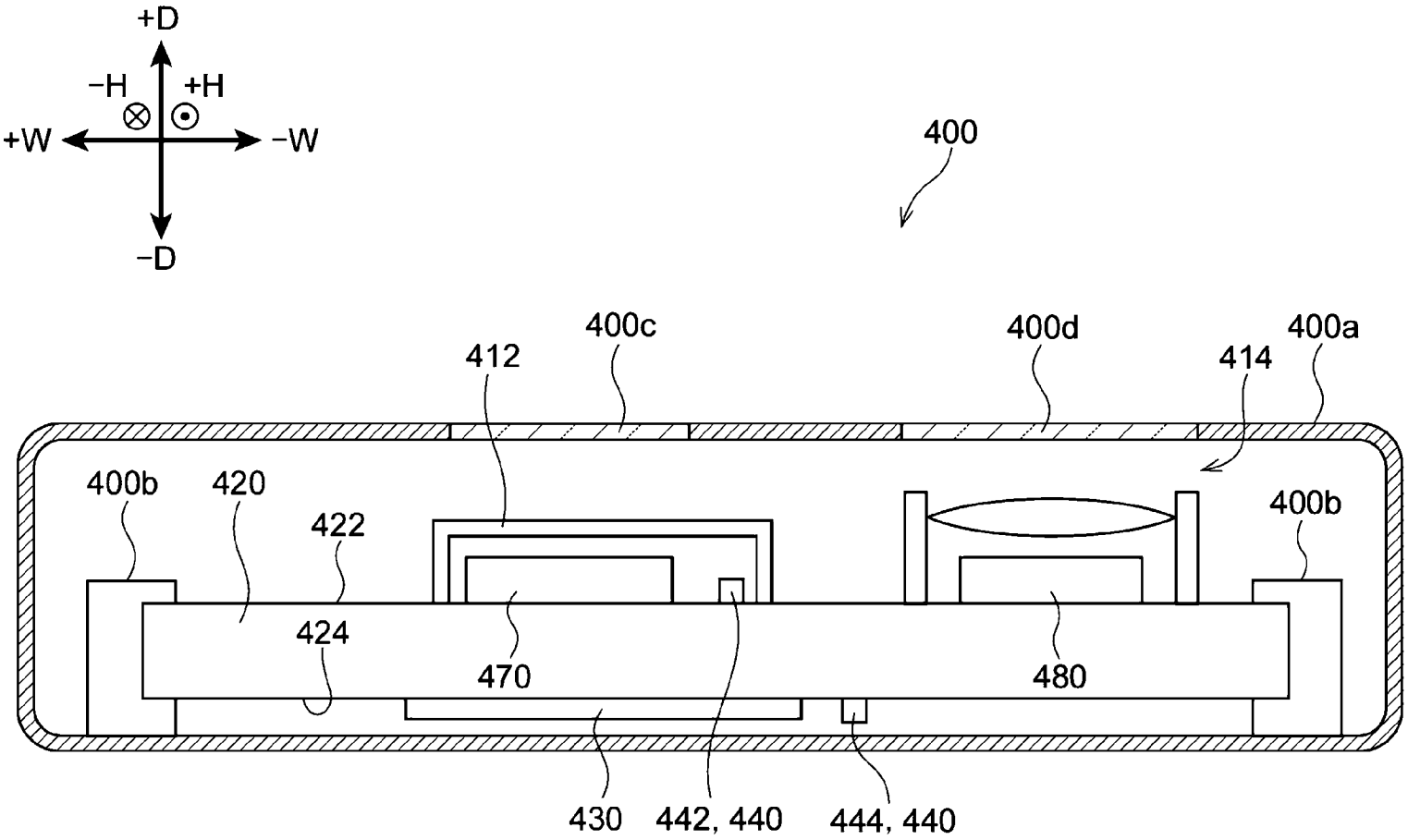
FIG. 11 is a cross-sectional plan view illustrating the configuration of an optical measurement apparatus according to the third exemplary embodiment.

As illustrated in FIG. 10, the base material 420 is a rectangular plate which is along H-W plane, and has a surface 422 facing +D side and a rear surface 424 facing −D side. The base material 20 is a rectangular plate which is along D-W plane and has an upper surface 22 facing +H side and a lower surface 24 facing −H side. The surface 422 is an example of a surface. The rear surface 424 is an example of another surface. The base material 420 is an example of a member. The base material 420 is, for example, a block made of metal, such as stainless steel, and has a higher stiffness than the later-described light emitter 470. The base material 420 is supported by the supporters 400*b* of the housing 400*a* so as not to be in contact with the housing 400*a*.

Note that the base material 420 in the present exemplary embodiment is not necessarily comprised of a metal block as long as the base material 420 has a higher stiffness than the light emitter 470. For example, the base material 420 may be comprised of sheet metal, or may be comprised of a resin material.

Light Emitter

The light emitter 470 has a function of emitting light to +D side. The light emitter 470 in the present exemplary embodiment is a VCSEL device mounted on a wiring substrate, and is mounted on the upper surface 422 of the base material 420 (see FIG. 11). That is, the light emitter 470 is disposed at the upper surface 422 of the base material 420. As illustrated in FIG. 10, when viewed in the device depth direction, the light emitter 470 has a rectangular shape smaller than the base material 420. The light emitter 470 has a lower stiffness than the base material 420. Specifically, the base material 420 has a higher bending stiffness in the D direction, and higher tensile, compressive stiffness in the H direction and D direction than the light emitter 470. The light emitter 470 has an increased stiffness in each of the above-mentioned directions by being mounted on the base material 420, as compared with when the light emitter 470 is singly provided.

The operation of the light emitter 470 is controlled by the controller 450. In addition, the light emitter 470 generates heat due to its light emission. The heat generated due to light emission of the light emitter 470 is transmitted to the upper surface 422 of the base material 420, and the heat is released. In other words, the light emitter 470 reduces excessive heat by releasing heat through the base material 420. In still other words, the light emitter 470 heats the surface 422 of the base material 420 due to light emission.

Heater

The heaters 430 are each a thin plate-shaped electric heater which is mounted on the rear surface 424 of the base material 420 and has a function of heating the rear surface 424. That is, each heater 430 has a function of heating the base material 420 from the rear surface 424. The heater 430 is disposed at the lower surface 24 of the base material 420. When viewed in the device depth direction, the heater 430 has a rectangular shape smaller than the base material 420 and larger than the light emitter 470, and the light emitter 470 is disposed to be located inside the heater 430. Specifically, the position of the heater 430 in the device width direction overlaps with the light emitter 470. Furthermore, the position of the heater 430 in the device width direction overlaps with part of the light emitter 470. The position of the heater 430 in the device up-down direction overlaps with the light emitter 470. Furthermore, the position of the heater 430 in the device up-down direction overlaps with part of the light emitter 470. The operation of the heater 430 is controlled by the controller 450.

Detector

The detector 440 has a function of detecting the temperature of the base material 420. As illustrated in FIG. 11, the detector 440 includes a front-side detector 442, and a rear-side detector 444. The front-side detector 442 is a temperature sensor mounted on the surface 422 of the base material 420, and has a function of detecting the temperature of the surface 422 of the base material 420. That is, the detector 440 detects the temperature at the surface 422 of the base material 420. The rear-side detector 444 is a temperature sensor mounted on the rear surface 424 of the base material 420, and has a function of detecting the temperature of the rear surface 424 of the base material 420. That is, the detector 440 detects the temperature at the rear surface 424 of the base material 420.

Light Receiver

The light receiver 480 is a three-dimensional sensor having a function of emitting light from the light emitter 470 to a user (not illustrated) away from the optical measurement device 400 to +D side and receiving light reflected from the user (not illustrated). The light receiver 480 is disposed at the surface 422 of the base material 420, and specifically disposed at a predetermined position which is shifted to −W side relative to the light emitter 470. That is, the light receiver 480 is disposed at a predetermined relative position with respect to the light receiver 470. The light receiver 480 is an example of another component.

Figure 12:
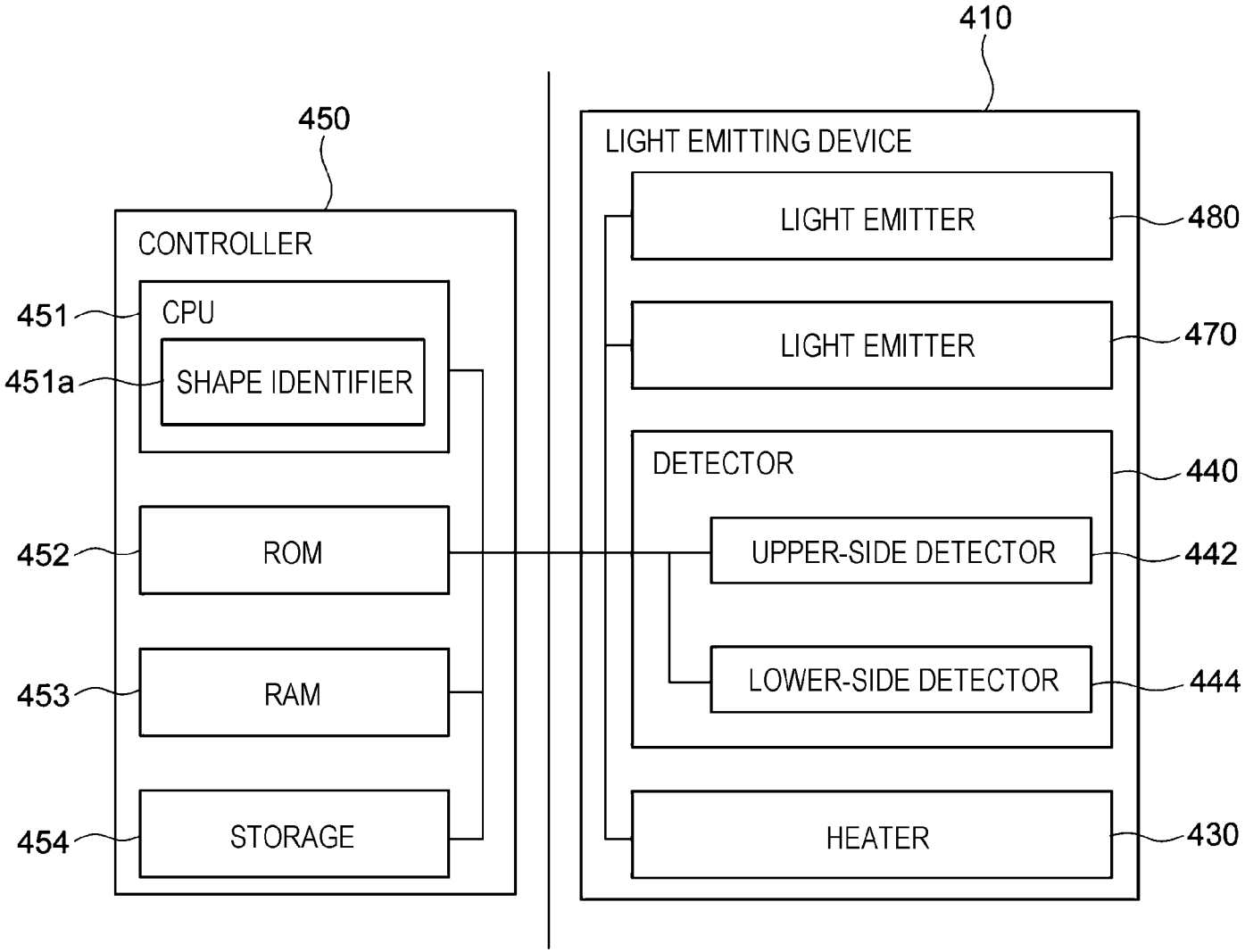
FIG. 12 is a block diagram illustrating the hardware configuration of the optical measurement apparatus according to the third exemplary embodiment.

FIG. 12 is a block diagram illustrating the hardware configuration of the light emitting device 410. In the light emitting device 410, the light receiver 480, the light emitter 470, the heater 430, the detector 440, and the controller 450 are coupled to each other via a bus to enable mutual communication.

Controller

As illustrated in FIG. 12, the controller 450 includes a CPU 451, a ROM 452, a RAM 453, and a storage 454. The CPU 451 is a central arithmetic processing unit that executes various programs, and controls the components. Specifically, the CPU 451 reads a program from the ROM 452 or the storage 454, and executes the program using the RAM 453 as a work area. The CPU 451 performs control on the above-mentioned components and various types of arithmetic processing in accordance with a program recorded in the ROM 452 or the storage 454. In the present exemplary embodiment, the ROM 452 or the storage 454 stores a temperature distribution calculation program that calculates the temperature distribution inside the base material 420 from results of detection by the detector 440 of the temperature at the upper surface 422 and the temperature at the lower surface 424 of the base material 420. In addition, the ROM 452 or the storage 454 stores a temperature difference control program that causes the heater 430 to operate so as to reduce the temperature difference inside the base material 420 based on the result of calculation of the temperature distribution calculation program. In another exemplary embodiment, the ROM 452 or the storage 454 stores a temperature control program that causes the heater 430 to operate so that the internal temperature of the base material 420 reaches a defined target temperature based on the result of calculation of the temperature distribution calculation program. The controller 450 has a function of controlling the heater 430 by these programs based on the result of the detection by the detector 440.

The ROM 452 or the storage 454 stores a shape identification program that identifies the three-dimensional shape of a user (not illustrated) irradiated with light from the light emitter 470, based on the light received by the light receiver 480. The CPU 451 functions as a shape identifier 451*a* that identifies the three-dimensional shape of a user (not illustrated) irradiated with light from the light emitter 470, based on the light received by the light receiver 480 by the shape identification program. In other words, the optical measurement device 400 includes the shape identifier 451*a*.

The ROM 452 stores various programs and various data. The RAM 453 serving as a work area temporarily stores programs or data. The storage 454 is comprised of a HDD or an SSD, and stores various programs including an operating system, and various data.

Others

The diffuser 412 is an optical member provided over the surface 422 of the base material 420 to cover the light emitter 470 from +D side. The diffuser 412 diffuses the light radiated from the light emitter 470 to +D side, and increases the divergence angle of the light emitted to +D side by the diffuser 412 to a level greater than the divergence angle of the light radiated from the light emitter 470 to +D side, thus, implementing a function of increasing a radiation area. The diffuser 412 is disposed at a predetermined relative position with respect to the light emitter 470. The diffuser 412 is an example of another component.

The lens part 414 is an optical member provided over the surface 422 of the base material 420 to cover the light receiver 480 from +D side. The lens part 414 has a function of receiving light passing through the transmission plate 400*d* from the outside of the housing 400*a* and focusing the light to the light receiver 480. The lens part 414 is disposed at a predetermined relative position with respect to the light receiver 480. In addition, the lens part 414 is disposed at a predetermined relative position with respect to the light emitter 470. The lens part 414 is an example of another component.

Operation and Effect

Next, the light emitting device 410 and the optical measurement device 400 according to a third exemplary embodiment will be described. Note that in this description, when an embodiment is described in comparison with the third exemplary embodiment, and the same components as in the light emitting device 410 and the optical measurement device 400 are used, the symbols and names of the components are used as they are.

The light emitting device 410 includes the heater 430 disposed at the rear surface 424 of the base material 420. Thus, the light emitting device 410 of the third exemplary embodiment can provide the same effect as the first exemplary embodiment which includes the heater 30.

The light emitting device 410 further includes the detector 440, and the controller 450. Therefore, the light emitting device 410 of the third exemplary embodiment can provide the same effect as the first exemplary embodiment which includes the detector 40, and the controller 50.

The light emitting device 410 further includes the rear-side detector 444 that detects the temperature at the rear surface 424 of the base material 420. Thus, the light emitting device 410 of the third exemplary embodiment can provide the same effect as the first exemplary embodiment which includes the lower-side detector 44.

In addition, the light emitting device 410 further includes the front-side detector 442 that detects the temperature at the surface 422 of the base material 420. Thus, the light emitting device 410 of the third exemplary embodiment can provide the same effect as the first exemplary embodiment which includes the upper-side detector 42.

In the light emitting device 410, the position of the heater 430 in the device width direction and the device up-down direction overlaps with the light emitter 470. Thus, the light emitting device 410 of the third exemplary embodiment can provide the same effect as the first exemplary embodiment in which the position of the heater 30 in the horizontal direction overlaps with the light emitter 70.

In the light emitting device 410, the light emitter 470 is mounted on the surface 422 of the base material 420. Thus, the light emitting device 410 of the third exemplary embodiment can provide the same effect as the first exemplary embodiment in which the light emitter 70 is mounted on the upper surface 22 of the base material 20.

In addition, the light emitting device 410 further includes the light receiver 480 which is disposed at a predetermined relative position with respect to the light emitter 470. In the configuration in which the light emitter 470 is mounted on the base material 420, when the base material 420 is deformed, the relative position between the light emitter 470 and the light receiver 480 is changed. Since the light emitting device 410 includes the heater 430, thermal deformation of the base material 420 due to heat generation of the light emitter 470 is reduced, thus change in the relative position between the light emitter 470 and the light receiver 480 due to the thermal deformation of the base material 420 is reduced. Thus, in the configuration in which the base material 420 affects the relative position between the light emitter 470 and the light receiver 480, the light emitting device 410 of the third exemplary embodiment can reduce the change in the relative position between the light emitter 430 and the light receiver 480 due to the thermal deformation of the base material 420.

The light emitting device 410 further includes a shape identifier 411*a* that identifies the three-dimensional shape of an object (not illustrated) irradiated with light from the light emitter 470, based on the light received by the light receiver 480. Thus, in the configuration including the light receiver 480 and the shape identifier 411*a*, the light emitting device 410 of the third exemplary embodiment can improve the accuracy of identifying the object shape by the shape identifier 411*a*.

Although specific exemplary embodiments have been described in detail in the above, the present disclosure is not limited to those exemplary embodiments, and various types of modifications, changes, improvements are possible within a scope of the technical idea of the present disclosure.

For example, the light emitting devices 10, 410 and the exposure device 110 are assumed to include the detectors 40, 440, 140 and the controllers 50, 450, 150, respectively. However, the light emitting device according to the present disclosure does not need to include a detector and a controller, and may be configured to control the operation of the heaters based on the amount of emission of the light emitters.

In addition, the positions of the heaters 30, 130, 430 in a direction crossing the light emission direction of the light emitters 70, 170, 470 are assumed to overlap with the light emitters 70, 170, 470, respectively. However, the position of the heater according to the present disclosure in a direction crossing the light emission direction of a light emitter may be displaced relative to the light emitter.

The light emitters 70, 170, 470 are assumed to be mounted on the upper surfaces 22, 122 of the base materials 20, 120 and the surface 422 of the base material 420, respectively. However, the light emitter according to the present disclosure may be disposed at a position away from a member by being supported by a support other the member as long as the light emitter is disposed on the side in a light emission direction of the light emitter with respect to the member. In addition, the light emitting device according to the present disclosure may not have a connector which is attached to the member to support the light emitter disposed at a position away from the member.

In addition, the spacer 160 of the second exemplary embodiment is assumed to be disposed at each of three positions at intervals on one light emitter 170. However, the number of the connectors according to the present disclosure is not limited to three, and may be one, two or greater than or equal to four. Alternatively, the connectors according to the present disclosure may be disposed in the entire space between the light emitters and the upper surface of the member. In other words, a gap may not be formed between the light emitters and the upper surface of the member according to the present disclosure.

The heater 130 of the second exemplary embodiment is assumed to overlap in position with part of the spacers 160 in a direction crossing the light emission direction of the light emitter 170. However, the heater according to the present disclosure may overlap in position with the entire connectors or may be displaced from the entire connectors in a direction crossing the light emission direction of the light emitter.

The heater 130 of the second exemplary embodiment is assumed to be disposed at each of four positions at intervals in the device depth direction which is the longitudinal direction of the exposure device 110. However, the number of the heaters according to the present disclosure is not limited to four, and may be one, two, three or greater than or equal to five.

In the second exemplary embodiment, the light emitting device including the light emitter 170 has been described as the exposure device 110. However, the present disclosure may be applied to an optical device other than the exposure device 110, and may be applied to a reading device (for example, a contact image sensor).

Figure 13:
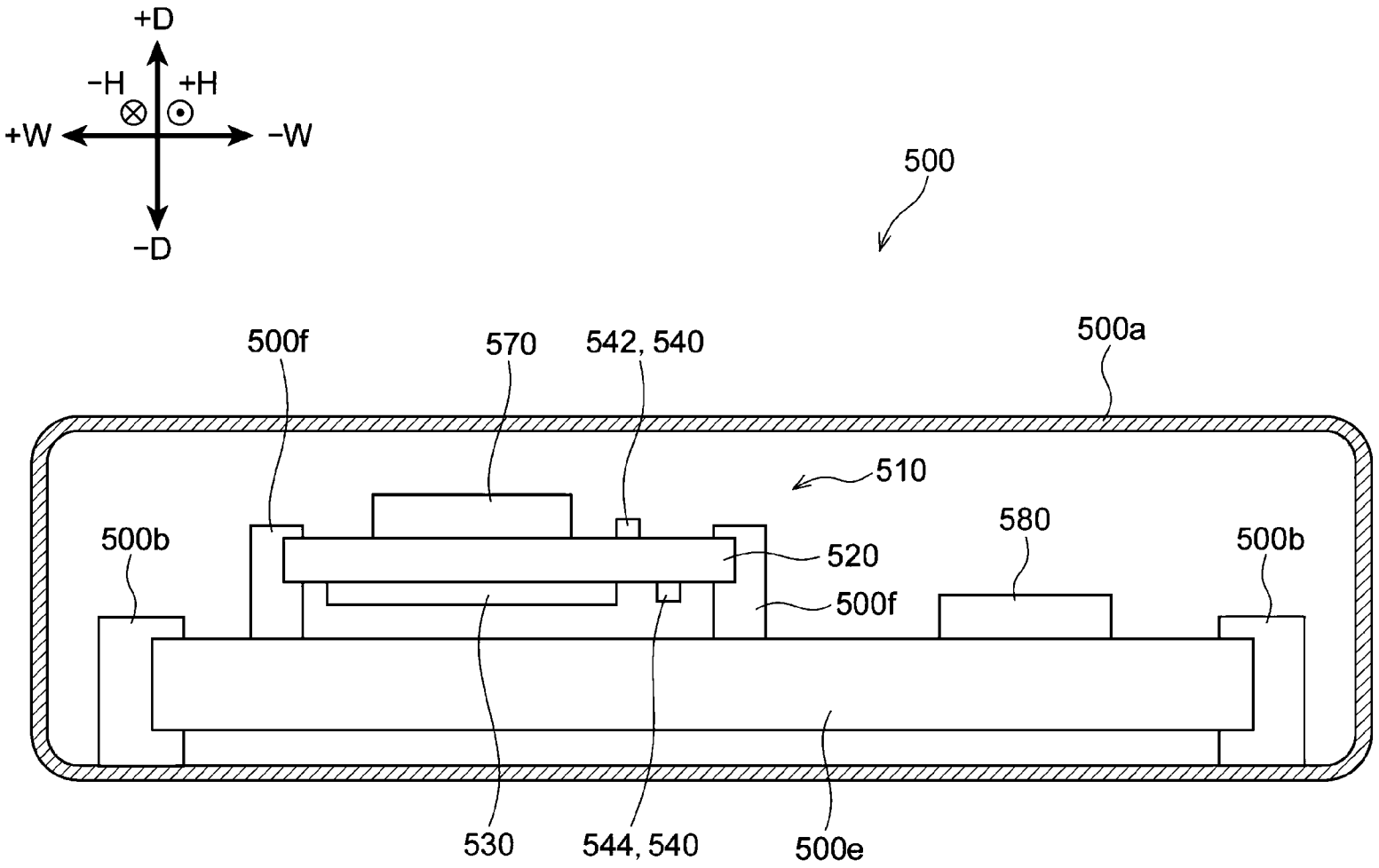
FIG. 13 is a cross-sectional plan view illustrating a modification of the optical measurement apparatus according to the third exemplary embodiment.
Figure 14:
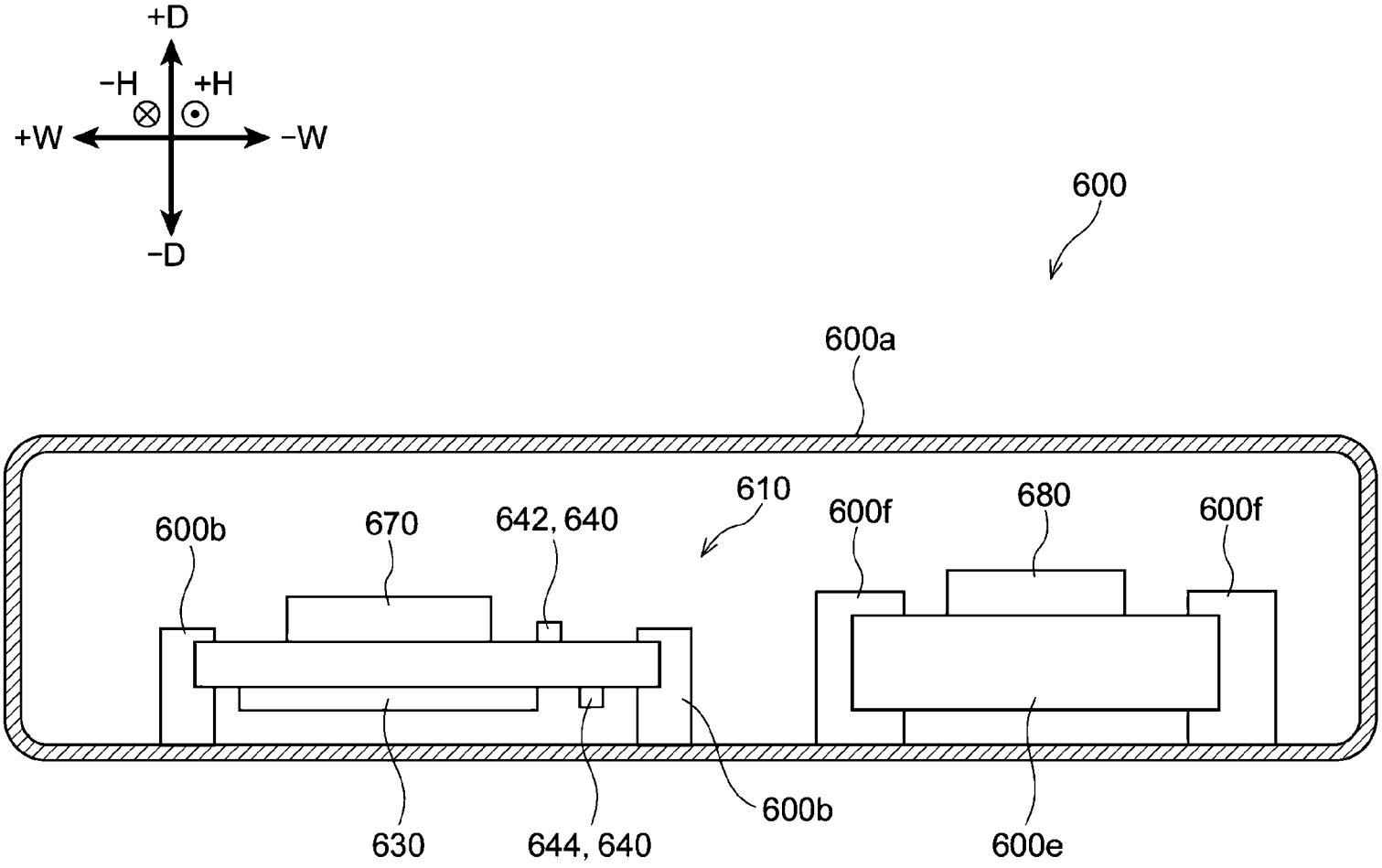
FIG. 14 is a cross-sectional plan view illustrating a modification of the optical measurement apparatus according to the third exemplary embodiment.

The optical measurement device 400 of the third exemplary embodiment is assumed to include the light emitting device 410 in which both the light emitter 470 and the light receiver 480 are mounted on the base material 420. However, in the present disclosure, when one of a light emitter and another component disposed at a predetermined relative position with respect to the light emitter is mounted on the member, the other of the light emitter and another component may not be mounted on the member. As illustrated in FIG. 13, for example, the optical measurement device according to the present disclosure may be an optical measurement device 500 in which a light emitting device 510 including a light emitter 570 mounted on a base material 520 is supported by a support 500*f* provided in another base material 500*e* with a light receiver 580 mounted. As illustrated in FIG. 14, the optical measurement device according to the present disclosure may be an optical measurement device 600 including a light emitting device 610 having a light emitter 670 mounted on a base material 620, and a light receiver 680 mounted on another base material 600*e*.

In the embodiments described above, the case has been described in which the present disclosure is applied to an optical measurement device and an image forming apparatus. However, the present disclosure may be applied to optical transmission by combining a light emitting device, an optical transmission path, and a light receiving unit, or to living body detection which uses light emitted from a light emitting device inside a detection target.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A light emitting device comprising:

a member having a first surface facing in one direction and a second surface facing an opposite side to the first surface;

a light emitter, being an emitting device mounted on a wiring substrate, that is disposed at the first surface of the member, generates heat due to light emission, and has a lower stiffness than the member; and a heater that is disposed at the second surface of the member, and heats the member from the second surface.

2. The light emitting device according to claim 1, further comprising:

a detector that detects a temperature of the member; and a controller that controls the heater based on a result of detection of the detector.

3. The light emitting device according to claim 2, wherein the detector detects a temperature at the second surface of the member.

4. The light emitting device according to claim 3, wherein the detector further detects a temperature at the first surface of the member.

5. The light emitting device according to claim 4, wherein a position of the heater in a cross direction crossing the one direction overlaps with the light emitter.

6. The light emitting device according to claim 3, wherein a position of the heater in a cross direction crossing the one direction overlaps with the light emitter.

7. The light emitting device according to claim 3, wherein the light emitter is mounted on the first surface.

8. The light emitting device according to claim 2, wherein a position of the heater in a cross direction crossing the one direction overlaps with the light emitter.

9. The light emitting device according to claim 2, wherein the light emitter is mounted on the first surface.

10. The light emitting device according to claim 1, wherein a position of the heater in a cross direction crossing the one direction overlaps with the light emitter.

11. The light emitting device according to claim 1, wherein the light emitter is mounted on the first surface.

12. The light emitting device according to claim 11, wherein the light emitter is away from the first surface, and mounted over the first surface with a connector interposed between the light emitter and the first surface.

13. The light emitting device according to claim 12, wherein a plurality of connectors, each of which is the connector, are disposed at intervals on one light emitter, and a gap is formed between the light emitter and the first surface.

14. The light emitting device according to claim 12, wherein a position of the heater in a cross direction crossing the one direction overlaps with the connector.

15. The light emitting device according to claim 1, wherein a plurality of heaters, each of which is the heater, are disposed at intervals in a cross direction crossing the one direction.

16. The light emitting device according to claim 1, wherein the member and the light emitter extend in a cross direction crossing the one direction.

17. The light emitting device according to claim 16, wherein a plurality of light emitters, each of which is the light emitter, are disposed in a zigzag pattern in the cross direction, and one-side end of the light emitter in the cross direction, and the other-side end of another adjacent light emitter in the cross direction are overlapped in position in the cross direction.

18. The light emitting device according to claim 1, further comprising:

other component disposed at a predetermined relative position with respect to the light emitter, wherein at least one of the light emitter or the other component is mounted on the member.

19. An optical measurement apparatus comprising:

a light emitting device according to claim 18, wherein the other component is a light receiver that, upon emission of light from the light emitter to an object away in the one direction, receives light reflected from the object; and a shape identifier that identifies a three-dimensional shape of the object based on the light received by the light receiver.

20. An image forming apparatus comprising:

an image carrier;

the light emitting device according to claim 1, wherein an electrostatic latent image is formed by imaging light on the image carrier charged, and the heater is mounted on the member; and a developing device that develops the electrostatic latent image of the image carrier to form an image.

* * * * *